US011004400B2

(12) United States Patent
Yoon et al.

(10) Patent No.: US 11,004,400 B2
(45) Date of Patent: May 11, 2021

(54) DISPLAY DEVICE COMPENSATING FOR HORIZONTAL CROSSTALK

(71) Applicant: Samsung Display Co., Ltd., Yongin-si (KR)

(72) Inventors: Changnoh Yoon, Seoul (KR); Soon-Dong Kim, Osan-si (KR); Jin-Wook Yang, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/746,297

(22) Filed: Jan. 17, 2020

(65) Prior Publication Data

US 2020/0365090 A1 Nov. 19, 2020

(30) Foreign Application Priority Data

May 17, 2019 (KR) ..... 10-2019-0058130

(51) Int. Cl.
*G09G 3/3275* (2016.01)
*G09G 3/20* (2006.01)

(52) U.S. Cl.
CPC ..... *G09G 3/3275* (2013.01); *G09G 3/2007* (2013.01); *G09G 2320/0209* (2013.01); *G09G 2320/0673* (2013.01)

(58) Field of Classification Search
CPC ..... G09G 3/3275; G09G 3/2007; G09G 2320/0209; G09G 2320/0673
See application file for complete search history.

(56) References Cited

U.S. PATENT DOCUMENTS 8,988,334 B2 * 3/2015 Ge ..... G09G 3/3614 345/96
2005/0088105 A1 * 4/2005 Tajiri ..... G09G 3/367 315/169.3
2008/0129893 A1 * 6/2008 Aoki ..... H04N 9/312 348/751

(Continued)

FOREIGN PATENT DOCUMENTS

CN 109841187 A 6/2019
JP 2009-104053 A 5/2009

(Continued)

*Primary Examiner* — Ricardo Osorio
(74) *Attorney, Agent, or Firm* — Lewis Roca Rothgerber Christie LLP

(57) ABSTRACT

A display device includes a display panel including a plurality of pixels, a gray group data generator configured to receive current line data for pixels in a current row, and to generate current row gray group data based on the current line data, a horizontal crosstalk determiner configured to determine whether horizontal crosstalk occurs in the current row, a horizontal crosstalk compensator configured to compare the current row gray group data with adjacent row gray group data when the horizontal crosstalk is determined to occur in the current row, and to selectively adjust a plurality of gamma reference voltages according to a result of the comparison between the current row gray group data and the adjacent row gray group data, and a data driver configured to generate and provide data voltages corresponding to the current line data based on the selectively adjusted plurality of gamma reference voltages.

15 Claims, 15 Drawing Sheets

(56) References Cited

U.S. PATENT DOCUMENTS

| | | | | |
|---|---|---|---|---|
| 2013/0050800 | A1* | 2/2013 | Maeda | B41J 2/465<br>359/290 |
| 2015/0077725 | A1* | 3/2015 | Shibayama | H04N 9/3152<br>353/99 |
| 2015/0348481 | A1* | 12/2015 | Hong | G09G 3/3685<br>345/690 |
| 2019/0045114 | A1* | 2/2019 | Ishibashi | H04N 5/2254 |
| 2019/0084419 | A1* | 3/2019 | Suzuki | G09G 3/346 |

FOREIGN PATENT DOCUMENTS

| | | | |
|---|---|---|---|
| KR | 10-1005902 | B1 | 1/2011 |
| KR | 10-2011-0063021 | A | 6/2011 |
| KR | 10-2015-0107484 | A | 9/2015 |
| KR | 10-2019-0014298 | A | 2/2019 |

* cited by examiner

DISPLAY DEVICE COMPENSATING FOR HORIZONTAL CROSSTALK

CROSS-REFERENCE TO RELATED APPLICATION(S)

This application claims priority to and the benefit of Korean Patent Application No. 10-2019-0058130, filed on May 17, 2019 in the Korean Intellectual Property Office (KIPO), the entire content of which is incorporated herein in its entirety by reference.

BACKGROUND

1. Field

Exemplary embodiments of the present inventive concept relate to a display device, and more particularly to a display device compensating for horizontal crosstalk.

2. Description of the Related Art

A display device, such as an organic light emitting diode (OLED) display device, includes a plurality of pixels connected to a plurality of gate lines and a plurality of data lines. Each pixel may receive a gate voltage through the gate line during a scan on time (SOT) (or a gate on time), and may receive a data voltage through the data line during the SOT.

In a case where low luminance data (e.g., black data) is provided with respect to pixels in the same row connected to the same gate line, high data voltages corresponding to the low luminance data may be applied to the pixels (including PMOS transistors), a gate load of the gate line may be increased by the high data voltages, and the scan on time for the pixels may be decreased by the increased gate load. If the scan on time is decreased, the pixels in the same row may store the data voltages having a voltage level lower than a desired voltage level, and thus may emit light with luminance higher than desired luminance based on the stored data voltages having the lower voltage level. Further, in a case where high luminance data (e.g., white data) is provided with respect to the pixels in the same row, the scan on time for the pixels may be increased, and the pixels in the same row may emit light with luminance lower than a desired luminance. These luminance distortions of the pixels in the same row may be referred to as horizontal crosstalk.

SUMMARY

Some example embodiments provide a display device capable of compensating for horizontal crosstalk.

According to example embodiments, there is provided a display device including a display panel including a plurality of pixels, a gray group data generator configured to receive current line data for pixels located in a current row from among the plurality of pixels, and to generate current row gray group data representing a reference gray group distribution of the current row based on the current line data, a horizontal crosstalk determiner configured to determine whether horizontal crosstalk occurs in the current row based on a difference between a plurality of pixel data included in the current line data, a horizontal crosstalk compensator configured to compare the current row gray group data with adjacent row gray group data representing the reference gray group distribution of an adjacent row when the horizontal crosstalk is determined to occur in the current row, and to selectively adjust a plurality of gamma reference voltages according to a result of the comparison between the current row gray group data and the adjacent row gray group data, and a data driver configured to generate data voltages corresponding to the current line data based on the selectively adjusted plurality of gamma reference voltages, and to provide the data voltages to the pixels located in the current row.

In example embodiments, the gray group data generator may include a gray group classifier configured to sequentially receive the plurality of pixel data included in the current line data, and to classify the plurality of pixel data into a plurality of reference gray groups respectively corresponding to a plurality of reference gray levels, a current group data accumulator configured to generate the current row gray group data by accumulating numbers of the plurality of pixel data respectively pertaining to the plurality of reference gray groups until receiving the current line data is completed, and at least one gray group data register configured to store the current row gray group data after receiving the current line data is completed.

In example embodiments, the at least one gray group data register may include a first gray group data register, a second gray group data register, and a third gray group data register. After receiving (N−1)-th line data for an (N−1)-th row as the current line data is completed, (N−1)-th row gray group data may be stored in the first gray group data register, where N is an integer greater than 1. After receiving N-th line data for an N-th row as the current line data is completed, N-th row gray group data may be stored in the first gray group data register, and the (N−1)-th row gray group data may be stored in the second gray group data register. After receiving (N+1)-th line data for an (N+1)-th row as the current line data is completed, (N+1)-th row gray group data may be stored in the first gray group data register, the N-th row gray group data may be stored in the second gray group data register, and the (N−1)-th row gray group data may be stored in the third gray group data register.

In example embodiments, the horizontal crosstalk determiner may include a pixel data difference calculator configured to sequentially receive the plurality of pixel data included in the current line data, and to calculate a pixel data difference between two adjacent pixel data from among the plurality of pixel data, a threshold difference comparator configured to compare the pixel data difference with a threshold difference value, and to count a number of the pixel data difference exceeding the threshold difference value, and an excess count accumulator configured to store the counted number of the pixel data difference exceeding the threshold difference value.

In example embodiments, the horizontal crosstalk determiner may determine that the horizontal crosstalk occurs when the counted number stored in the excess count accumulator is greater than or equal to a reference count value.

In example embodiments, the horizontal crosstalk compensator may include a gray group data comparator configured to compare the current row gray group data with the adjacent row gray group data, and to determine whether a difference between the reference gray group distribution of the current row and the reference gray group distribution of the adjacent row is within a reference distribution difference range, and a gamma reference voltage controller configured to adjust the plurality of gamma reference voltages when the horizontal crosstalk is determined to occur in the current row and the difference between the reference gray group distribution of the current row and the reference gray group distribution of the adjacent row is within the reference distribution difference range.

In example embodiments, the gray group data comparator may determine that the difference between the reference gray group distribution of the current row and the reference gray group distribution of the adjacent row is within the reference distribution difference range when, with respect to each reference gray group, a difference between a number of the plurality of pixel data pertaining to the each reference gray group represented by the current row gray group data and a number of the plurality of pixel data pertaining to the each reference gray group represented by the adjacent row gray group data is less than or equal to a reference number difference.

In example embodiments, the gamma reference voltage controller may calculate a sum of the plurality of pixel data included in the current line data, may compare the sum of the plurality of pixel data with a line data reference value, and may adjust the plurality of gamma reference voltages according to a result of the comparison between the sum of the plurality of pixel data and the line data reference value.

In example embodiments, the gamma reference voltage controller may decrease the plurality of gamma reference voltages when the sum of the plurality of pixel data is greater than the line data reference value, and may increase the plurality of gamma reference voltages when the sum of the plurality of pixel data is less than the line data reference value.

In example embodiments, a decrement or an increment of the plurality of gamma reference voltages may be proportional to a difference between the sum of the plurality of pixel data and the line data reference value.

In example embodiments, the display device may further include a line data memory configured to store previous line data for a previous row and the current line data for the current row. When receiving next line data for a next row is completed, the line data memory may output the previous line data to the data driver, may store the current line data as the previous line data, and may store the next line data as the current line data.

According to example embodiments, there is provided a display device including a display panel including a plurality of pixels, a gray group data generator configured to receive current line data for pixels located in a current row from among the plurality of pixels, and to generate current row gray group data representing a reference gray group distribution of the current row based on the current line data, a horizontal crosstalk determiner configured to determine whether horizontal crosstalk occurs in the current row based on a sum of a plurality of pixel data included in the current line data, a horizontal crosstalk compensator configured to select reference gray groups among a plurality of reference gray groups based on the current row gray group data when the horizontal crosstalk is determined to occur in the current row, and to adjust gamma reference voltages corresponding to the selected reference gray groups among a plurality of gamma reference voltages, and a data driver configured to generate data voltages corresponding to the current line data based on the plurality of gamma reference voltages including the adjusted gamma reference voltages, and to provide the data voltages to the pixels located in the current row.

In example embodiments, the horizontal crosstalk determiner may calculate the sum of the plurality of pixel data included in the current line data, and may compare the sum of the plurality of pixel data with a line data reference value.

In example embodiments, the horizontal crosstalk determiner may determine that the horizontal crosstalk occurs in the current row when the sum of the plurality of pixel data is less than or equal to the line data reference value.

In example embodiments, the horizontal crosstalk compensator may select two reference gray groups among the plurality of reference gray groups, and may adjust two gamma reference voltages corresponding to the selected two reference gray groups among the plurality of gamma reference voltages.

In example embodiments, the horizontal crosstalk compensator may select the two reference gray groups to which a most number of the plurality of pixel data and a second most number of the plurality of pixel data pertain among the plurality of reference gray groups.

In example embodiments, the horizontal crosstalk compensator may increase a gamma reference voltage corresponding to a relatively high reference gray level among the two gamma reference voltages corresponding to the selected two reference gray groups, and may decrease a gamma reference voltage corresponding to a relatively low reference gray level among the two gamma reference voltages corresponding to the selected two reference gray groups.

According to example embodiments, there is provided a display device including a display panel including a plurality of pixels, a gray group data generator configured to receive current line data for pixels located in a current row from among the plurality of pixels, and to generate current row gray group data representing a reference gray group distribution of the current row based on the current line data, a horizontal crosstalk determiner configured to determine whether horizontal crosstalk occurs in the current row by analyzing the current line data, a horizontal crosstalk compensator configured to adjust a plurality of gamma reference voltages based on the current row gray group data when the horizontal crosstalk is determined to occur in the current row, and a data driver configured to generate data voltages corresponding to the current line data based on the adjusted plurality of gamma reference voltages, and to provide the data voltages to the pixels located in the current row.

In example embodiments, the horizontal crosstalk compensator may compare the current row gray group data with adjacent row gray group data representing the reference gray group distribution of an adjacent row, and may selectively adjust the plurality of gamma reference voltages according to a result of the comparison between the current row gray group data and the adjacent row gray group data.

In example embodiments, the horizontal crosstalk compensator may select reference gray groups among a plurality of reference gray groups based on the current row gray group data, and may adjust gamma reference voltages corresponding to the selected reference gray groups among the plurality of gamma reference voltages.

As described above, a display device according to example embodiments may determine, based on a difference between a plurality of pixel data included in current line data, whether horizontal crosstalk occurs in a current row, and may compare current row gray group data and adjacent row gray group data. Further, the display device according to example embodiments may adjust a plurality of gamma reference voltages when it is determined that the horizontal crosstalk occurs and a difference between a current row reference gray group distribution and an adjacent row reference gray group distribution is within a reference distribution difference range. Accordingly, the horizontal crosstalk may be compensated in substantially real time.

Further, a display device according to example embodiments may determine, based on a sum of a plurality of pixel data included in current line data, whether horizontal crosstalk occurs in a current row, may select reference gray groups based on current row gray group data, and may adjust gamma reference voltages corresponding to the selected reference gray groups. Accordingly, the horizontal crosstalk may be compensated in substantially real time.

BRIEF DESCRIPTION OF THE DRAWINGS

Illustrative, non-limiting example embodiments will be more clearly understood from the following detailed description in conjunction with the accompanying drawings.

DETAILED DESCRIPTION

Figure 1:
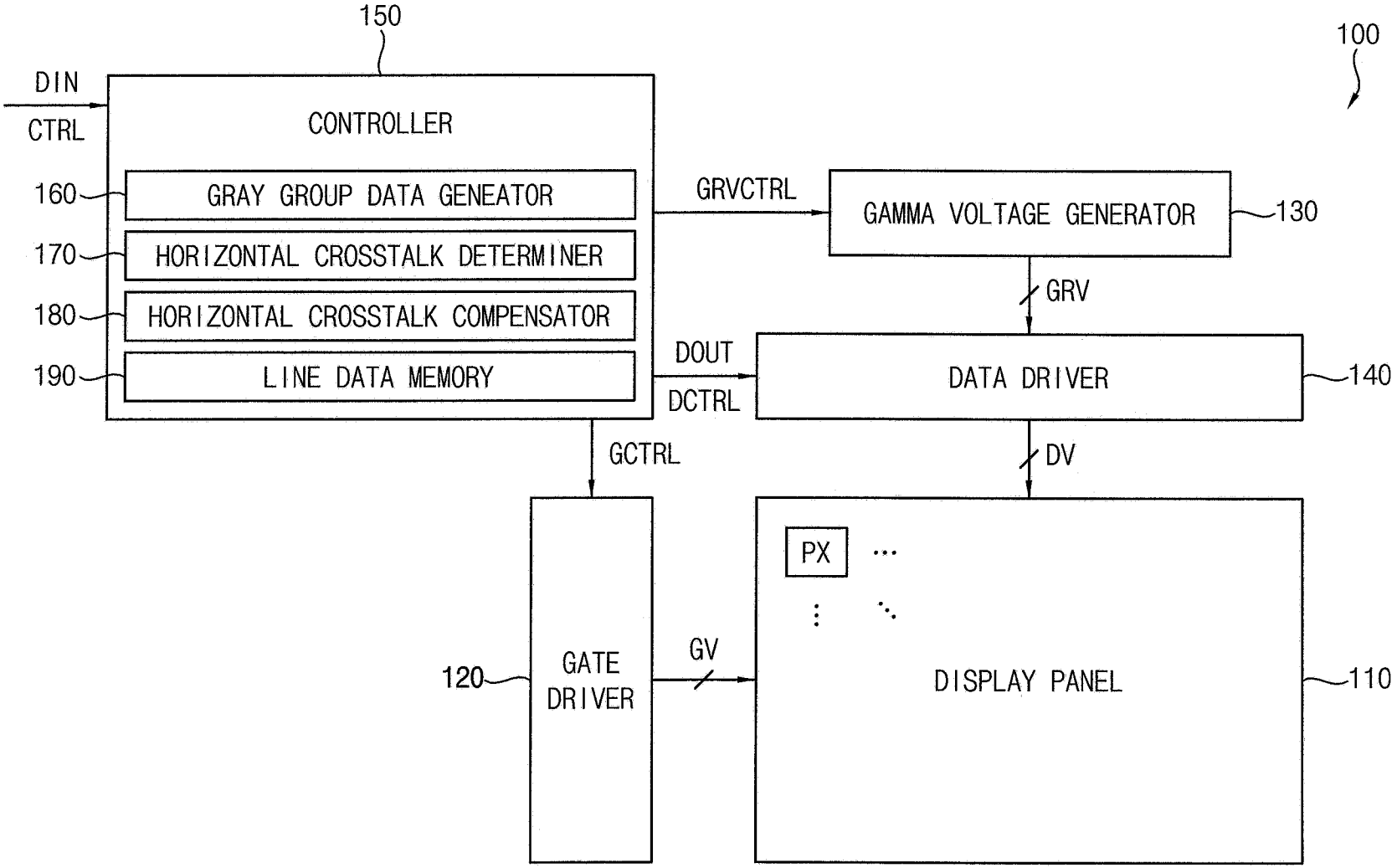
FIG. 1 is a block diagram illustrating a display device according to example embodiments.

Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof may not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Figure 2A:
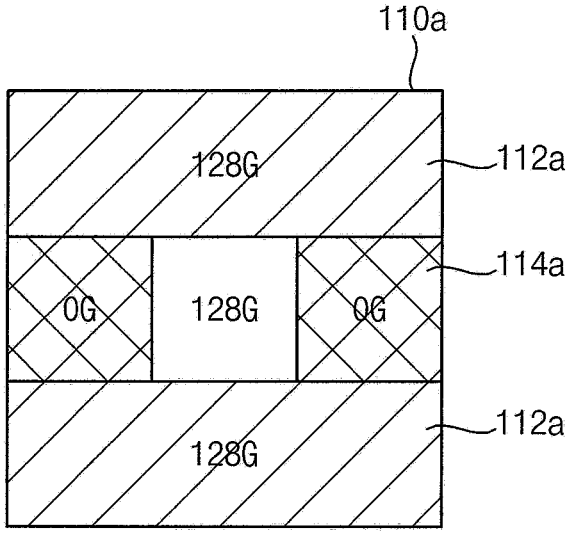
FIGS. 2A and 2B are diagrams for describing example where horizontal crosstalk occurs.
Figure 2B:
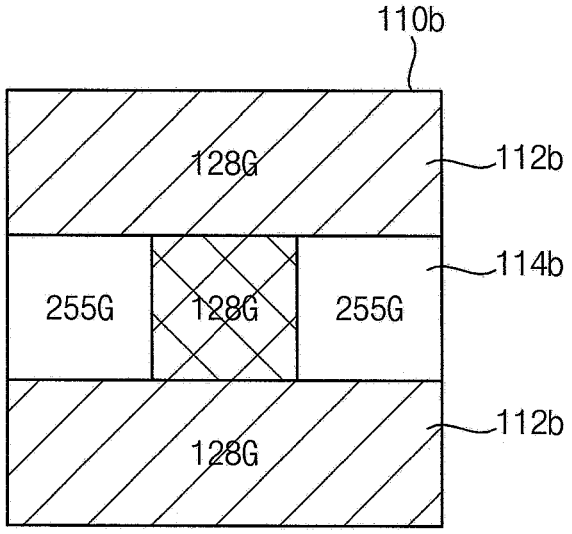

FIG. 1 is a block diagram illustrating a display device according to example embodiments, and FIGS. 2A and 2B are diagrams for describing example where horizontal crosstalk occurs.

Referring to FIG. 1, a display device 100 according to example embodiments may include a display panel 110 including a plurality of pixels PX, a gate driver 120 for providing gate voltages GV to the plurality of pixels PX, a gamma voltage generator 130 for providing a plurality of gamma reference voltages GRV to a data driver 140, the data driver 140 for providing data voltages DV to the plurality of pixels PX, and a controller 150 for controlling the gate driver 120, the gamma voltage generator 130 and the data driver 140. The display device 100 may further include a gray group data generator 160, a horizontal crosstalk determiner 170, a horizontal crosstalk compensator 180 and a line data memory 190. In some example embodiments, as illustrated in FIG. 1, the gray group data generator 160, the horizontal crosstalk determiner 170, the horizontal crosstalk compensator 180 and the line data memory 190 may be formed within the controller 150, but the locations of the gray group data generator 160, the horizontal crosstalk determiner 170, the horizontal crosstalk compensator 180, and the line data memory 190 are not limited to inside the controller 150.

The display panel 110 may include a plurality of gate lines, a plurality of data lines, and the plurality of pixels PX connected to the plurality of gate lines and the plurality of data lines. In some example embodiments, the display panel 110 may be an organic light emitting diode (OLED) display panel where each pixel PX may include at least two transistors, at least one capacitor and an OLED. In other example embodiments, the display panel 110 may be a liquid crystal display (LCD) panel, or any other suitable display panel as would be understood by one skilled in the art. In example embodiments, the transistors of each pixel PX may be implemented with PMOS transistors. In this case, each pixel PX may emit light with relatively low luminance in response to a relatively high data voltage DV, and may emit light with relatively high luminance in response to a relatively low data voltage DV. However, the transistors of each pixel PX may not be limited to the PMOS transistors and may be implemented with NMOS transistors or a combination of PMOS and NMOS transistors, as would be understood by one skilled in the art.

The gate driver 120 may generate the gate voltages GV based on a gate control signal GCTRL received from the controller 150, and may provide (e.g., sequentially provide) gate voltages GV to the plurality of pixels PX on a row-by-row basis. In some example embodiments, the gate control signal GCTRL may include, but is not limited to, a gate start pulse and a gate clock signal.

The gamma voltage generator 130 may provide the plurality of gamma reference voltages GRV respectively corresponding to a plurality of reference gray levels to the data driver 140. For example, gamma voltage generator 130 may generate the plurality of gamma reference voltages GRV respectively corresponding to the plurality of reference gray levels including a 0-gray level, a 3-gray level, an 11-gray level, a 23-gray level, a 35-gray level, a 51-gray level, an 87-gray level, an 151-gray level, a 203-gray level and a 255-gray level.

The data driver 140 may generate the data voltages DV based on a data control signal DCTRL and output image data DOUT received from the controller 150, and may provide the data voltages DV to the plurality of pixels PX through the plurality of data lines. In some example embodiments, the data control signal DCTRL may include, but is not limited to, a horizontal start signal and a load signal. In some example embodiments, the data driver 140 may receive the plurality of gamma reference voltages GRV from the gamma voltage generator 130, may generate gray voltages corresponding to all gray levels (e.g., from the 0-gray level to the 255-gray level) by dividing the plurality of gamma reference voltages GRV corresponding to the plurality of reference gray levels, may select the gray voltages according to the output image data DOUT, and may provide the selected gray voltages as the data voltages DV to the plurality of pixels PX.

The controller (e.g., a timing controller (TCON)) 150 may receive input image data DIN and a control signal CTRL from an external host processor (e.g., a graphic processing unit (GPU) or a graphic card). In some example embodiments, the input image data DIN may include, but is not limited to, RGB data having red (R) image data, green (G) image data and blue (B) image data. Further, in some example embodiments, the control signal CTRL may include, but is not limited to, a vertical synchronization signal, a horizontal synchronization signal, a dot clock signal, a data enable signal, etc. The controller 150 may control operations of the gate driver 120, the gamma voltage generator 130, and the data driver 140 based on the input image data DIN and the control signal CTRL.

In an example of FIG. 2A, data voltages (e.g., the same data voltages) DV corresponding to a 128-gray level 128G may be applied to the pixels PX in the same row in a first portion 112*a* of a display panel 110*a*. In a second portion 114*a* of the display panel 110*a*, data voltages DV corresponding to the 128-gray level 128G may be applied to a portion of the pixels PX in the same row, and data voltages DV corresponding to a 0-gray level 0G may be applied to another portion of the pixels PX in the same row. Gate loads of gate lines in the second portion 114*a* of the display panel 110*a* may be increased by the high data voltages DV corresponding to the 0-gray level 0G, and a scan on time (SOT) (or a gate on time) for the pixels PX in the second portion 114*a* of the display panel 110*a* may be decreased by the increased gate loads. If the SOT is decreased, the data voltages DV having a voltage level lower than a desired voltage level may be stored in the pixels PX in the second portion 114*a* of the display panel 110*a*, and the pixels PX in the second portion 114*a* of the display panel 110*a* may emit light with luminance that is higher than desired luminance. For example, in comparison to the pixels PX receiving the data voltages DV corresponding to the 128-gray level 128G in the first portion 112*a* of the display panel 110*a*, the pixels PX receiving the data voltages DV corresponding to the 128-gray level 128G in the second portion 114*a* of the display panel 110*a* may emit light with relatively high luminance.

In an example of FIG. 2B, data voltages (e.g., the same data voltages) DV corresponding to the 128-gray level 128G may be applied to the pixels PX in a row in a first portion 112*b* of a display panel 110*b*. In a second portion 114*b* of the display panel 110*b*, data voltages DV corresponding to the 128-gray level 128G may be applied to a portion of the pixels PX in the same row, and data voltages DV corresponding to a 255-gray level 255G may be applied to another portion of the pixels PX in the same row. Gate loads of gate lines in the second portion 114*b* of the display panel 110*b* may be decreased by the low data voltages DV corresponding to the 255-gray level 255G, and an SOT for the pixels PX in the second portion 114*b* of the display panel 110*b* may be increased by the decreased gate loads. When the SOT is increased, the data voltages DV having a voltage level higher than a desired voltage level may be stored in the pixels PX in the second portion 114*b* of the display panel 110*b*, and the pixels PX in the second portion 114*b* of the display panel 110*b* may emit light with luminance lower than desired luminance. For example, when compared with the pixels PX receiving the data voltages DV corresponding to the 128-gray level 128G in the first portion 112*b* of the display panel 110*b*, the pixels PX receiving the data voltages DV corresponding to the 128-gray level 128G in the second portion 114*b* of the display panel 110*b* may emit light with relatively low luminance.

As illustrated in FIGS. 2A and 2B, in a case where low gray data or low luminance data (e.g., black data), or high gray data or high luminance data (e.g., white data) is provided with respect to at least a portion of the pixels PX in the same row, luminance distortions in which luminance of the pixels PX in the same row increases or decreases compared with a desired luminance may occur. These luminance distortions of the pixels PX in the same row may be referred to as horizontal crosstalk.

To compensate for this horizontal crosstalk, the display device 100 according to example embodiments may include the gray group data generator 160, the horizontal crosstalk determiner 170, the horizontal crosstalk compensator 180, and the line data memory 190.

In some example embodiments, the gray group data generator 160 may receive (e.g., sequentially receive), as the input image data DIN, a plurality of line data in an order from the first row to the last row of the display panel 110, and may generate current row gray group data representing a reference gray group distribution of a current row based on current line data for the pixels PX located in the current row. The horizontal crosstalk determiner 170 may determine, based on a difference between a plurality of pixel data included in the current line data, whether horizontal crosstalk occurs in the current row. When the horizontal crosstalk is determined to occur in the current row, the horizontal crosstalk compensator 180 may compare the current row gray group data with adjacent row gray group data representing the reference gray group distribution of an adjacent row, and may selectively adjust the plurality of gamma reference voltages GRV according to a result of the comparison between the current row gray group data and the adjacent row gray group data. The data driver 140 may generate the data voltages DV corresponding to the current line data output from the line data memory 190 based on the selectively adjusted plurality of gamma reference voltages GRV, and may provide the data voltages DV to the pixels PX located in the current row. Accordingly, in the display device 100 according to example embodiments, the horizontal crosstalk may be compensated in substantially real time. This operation of the display device 100 according to example embodiments will be described below with reference to FIGS. 3-12.

In other example embodiments, the gray group data generator 160 may receive (e.g., sequentially receive), as the input image data DIN, the plurality of line data in the order from the first row to the last row of the display panel 110, and may generate current row gray group data representing a reference gray group distribution of a current row based on current line data for the pixels PX located in the current row. The horizontal crosstalk determiner 170 may determine, based on a sum of the plurality of pixel data included in the current line data, whether the horizontal crosstalk occurs in the current row. When the horizontal crosstalk is determined to occur in the current row, the horizontal crosstalk compensator 180 may select reference gray groups from among a plurality of reference gray groups based on the current row gray group data, and may adjust gamma reference voltages corresponding to the selected reference gray groups from among the plurality of gamma reference voltages GRV. The data driver 140 may generate the data voltages DV corresponding to the current line data output from the line data memory 190 based on the plurality of gamma reference voltages GRV including the adjusted gamma reference voltages, and may provide the data voltages DV to the pixels PX located in the current row. Accordingly, in the display device 100 according to example embodiments, the horizontal crosstalk may be compensated in substantially real time. This operation of the display device 100 according to example embodiments will be described below with reference to FIGS. 13-15.

As described above, in the display device 100 according to example embodiments, the gray group data generator 160 may generate the current row gray group data, the horizontal crosstalk determiner 170 may determine whether the horizontal crosstalk occurs in the current row, and the horizontal crosstalk compensator 180 may adjust the plurality of gamma reference voltages GRV based on the current row gray group data. Accordingly, in the display device 100 according to example embodiments, the horizontal crosstalk may be compensated in substantially real time.

Figure 3:
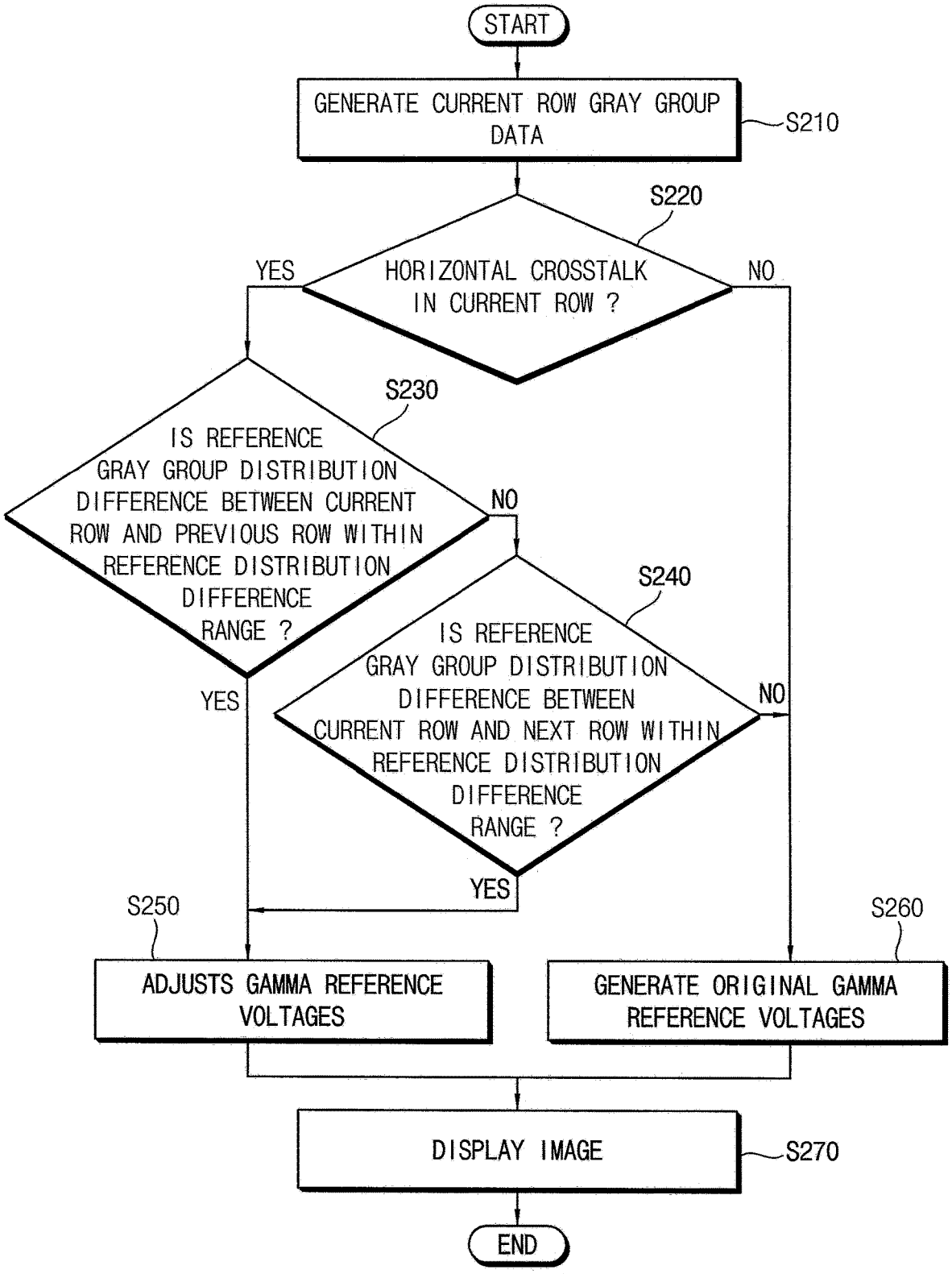
FIG. 3 is a flowchart illustrating a method of operating a display device according to example embodiments.
Figure 4:
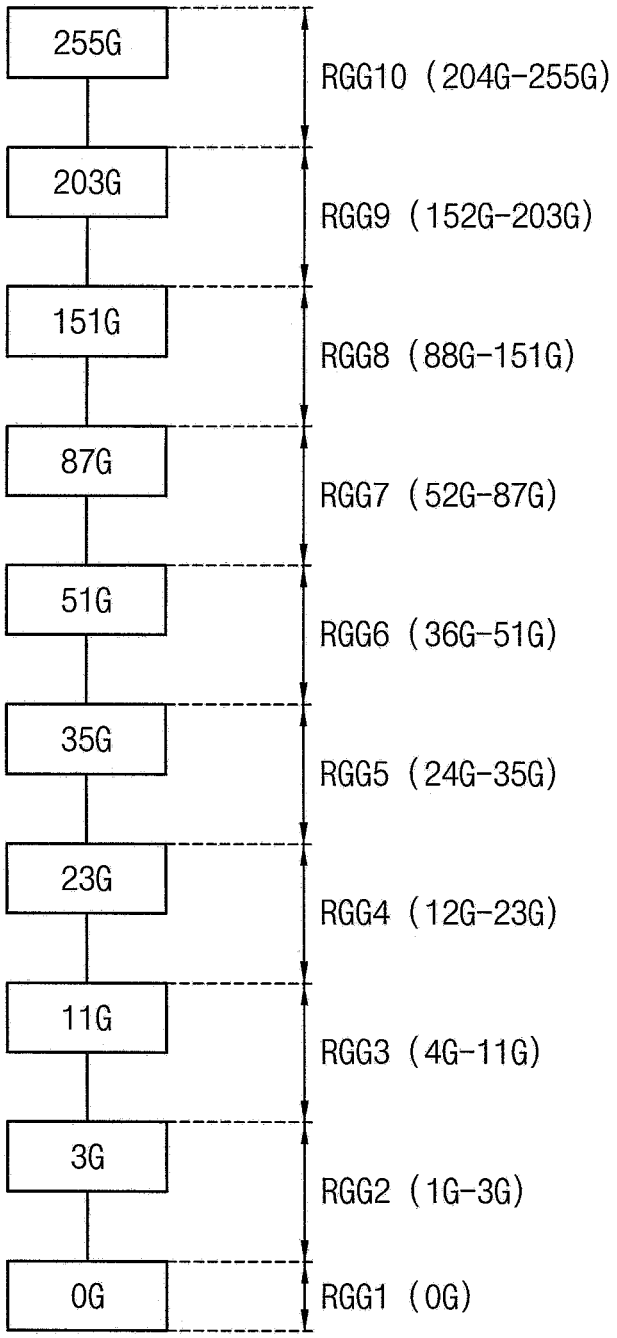
FIG. 4 is a diagram illustrating an example of a plurality of reference gray groups in a display device according to example embodiments.
Figure 5:
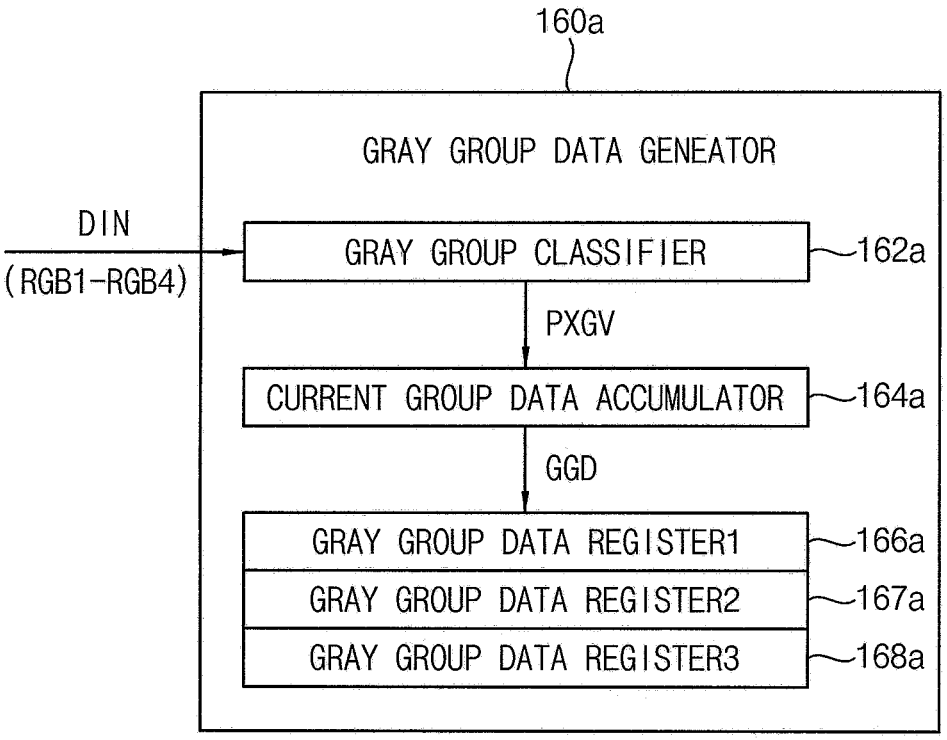
FIG. 5 is a block diagram illustrating a gray group data generator included in a display device according to example embodiments.
Figure 6:
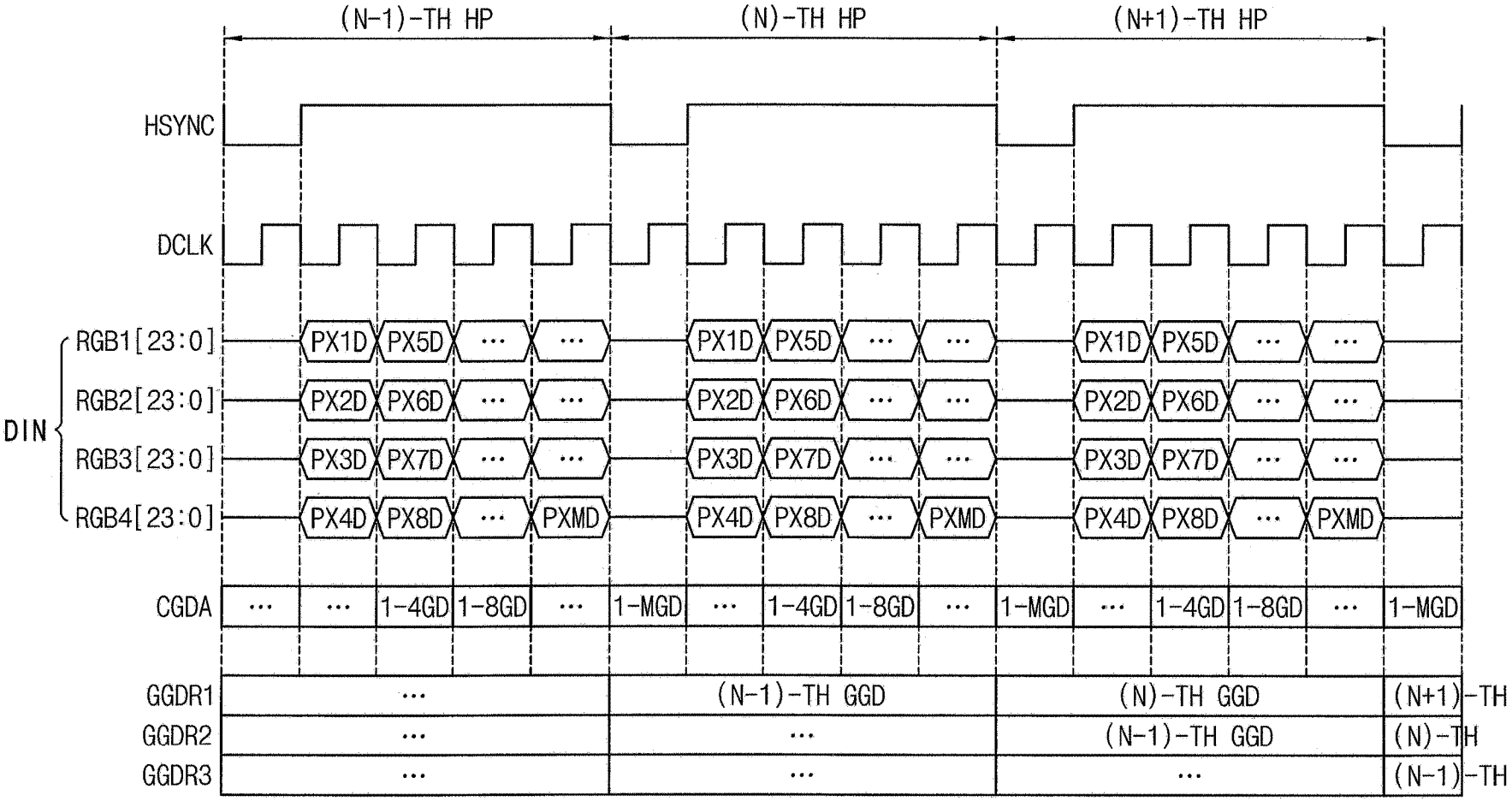
FIG. 6 is a timing diagram for describing an operation of the gray group data generator of FIG. 5 according to example embodiments.
Figure 7:
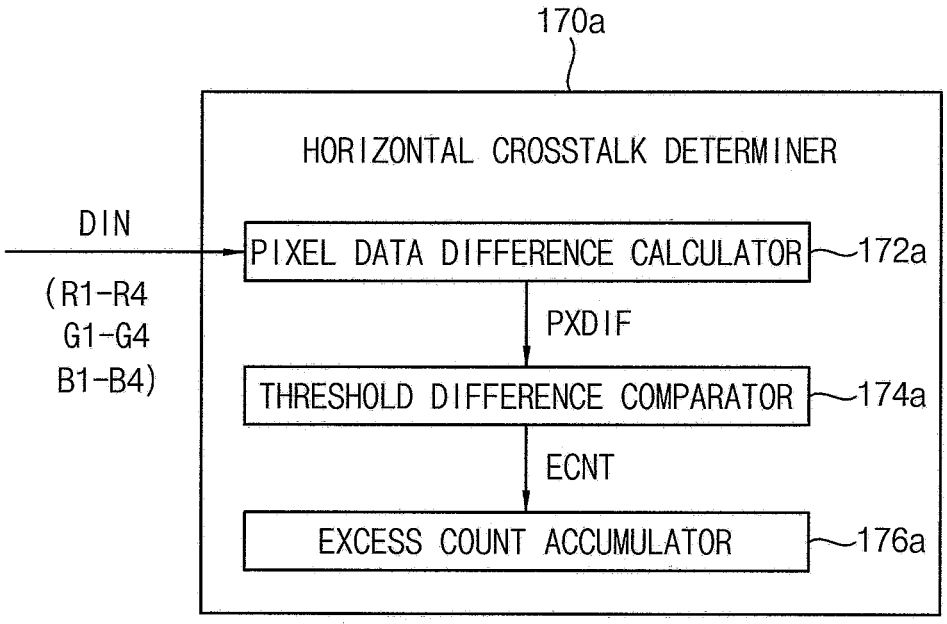
FIG. 7 is a block diagram illustrating a horizontal crosstalk determiner included in a display device according to example embodiments.
Figure 8:
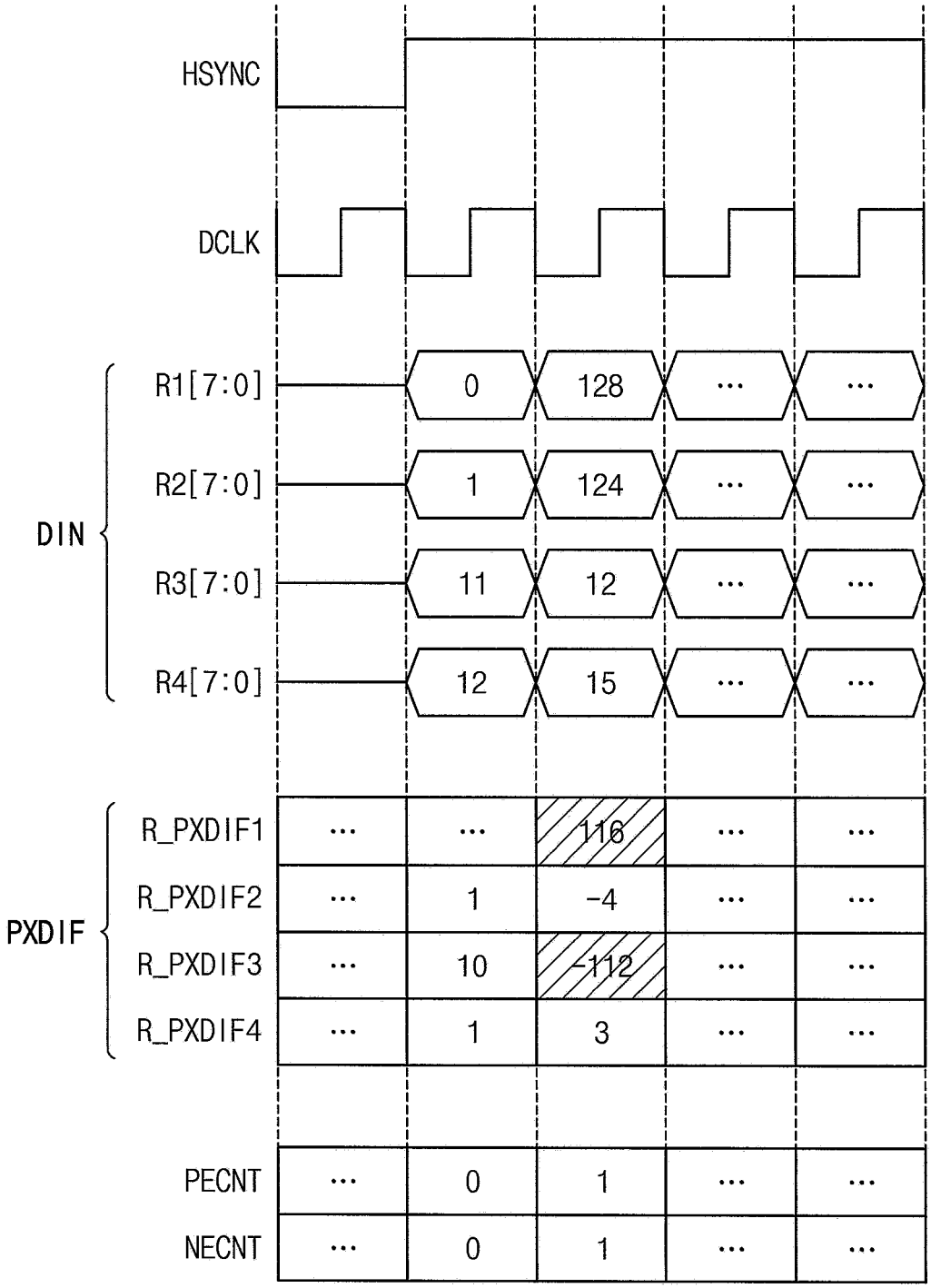
FIG. 8 is a timing diagram for describing an operation of the horizontal crosstalk determiner of FIG. 7 according to example embodiments.
Figure 9:
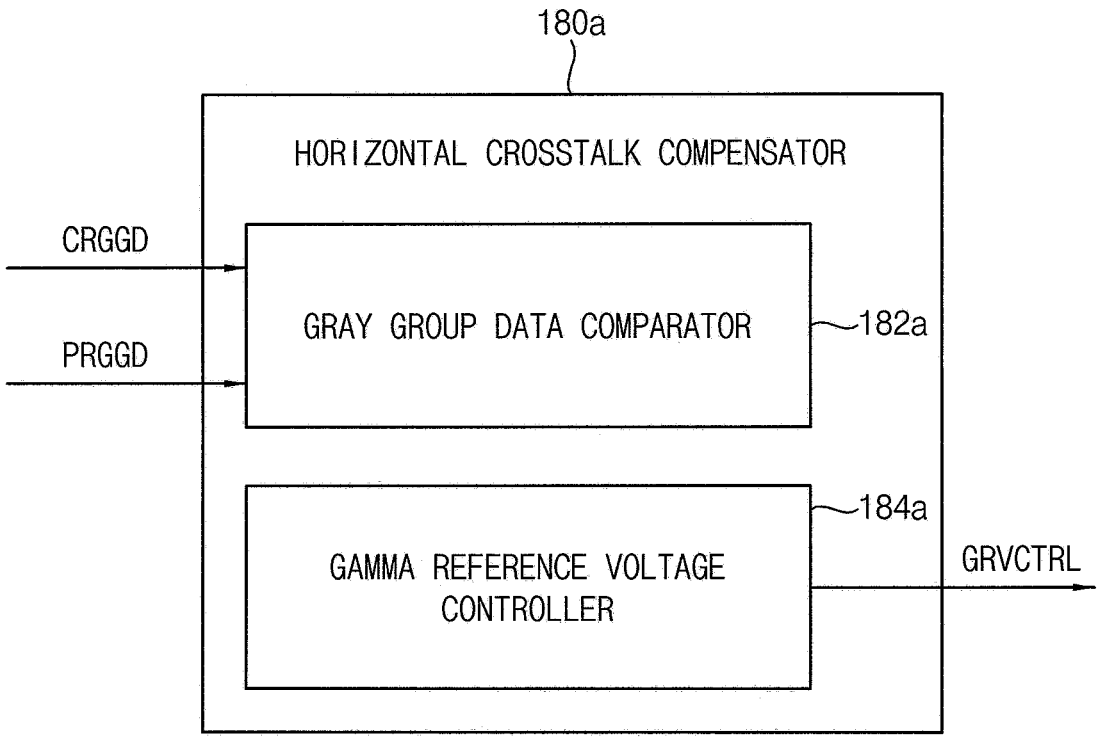
FIG. 9 is a block diagram illustrating a horizontal crosstalk compensator included in a display device according to example embodiments.
Figure 10A:
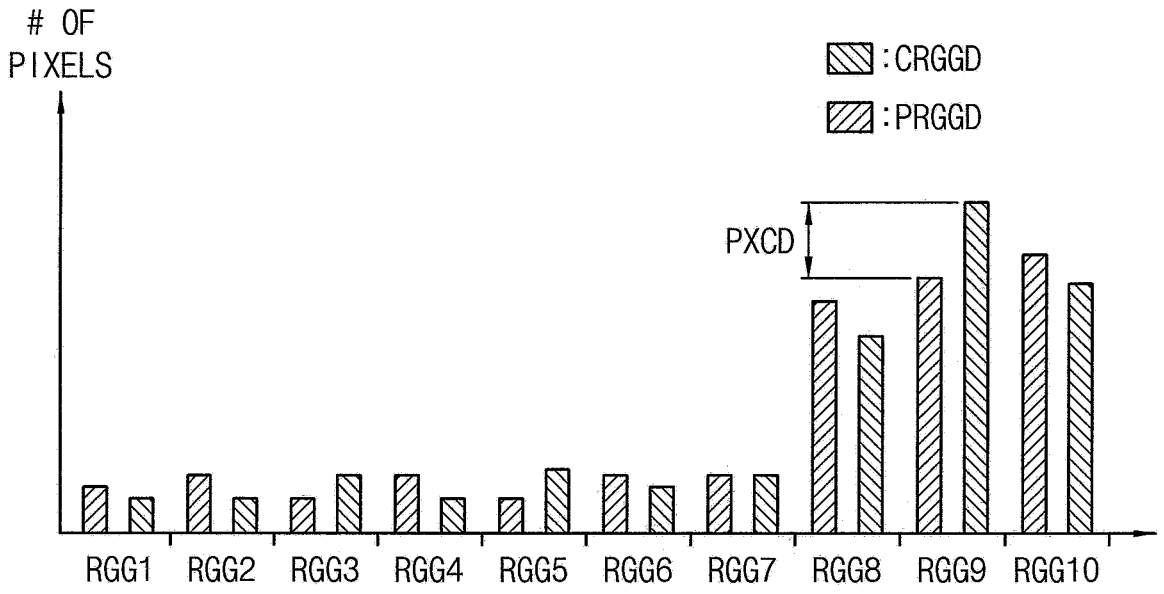
FIG. 10A is a diagram illustrating an example where a difference between a current row reference gray group distribution and an adjacent row reference gray group distribution is within a reference distribution difference range according to example embodiments.
Figure 10B:
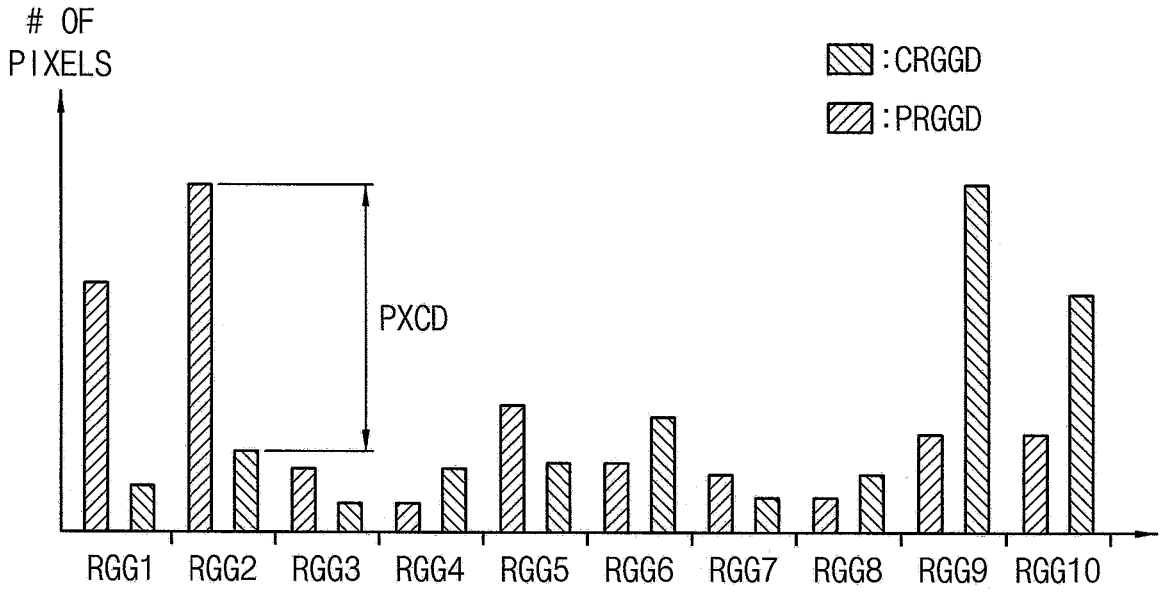
FIG. 10B is a diagram illustrating an example where a difference between a current row reference gray group distribution and an adjacent row reference gray group distribution exceeds a reference distribution difference range according to example embodiments.
Figure 11:
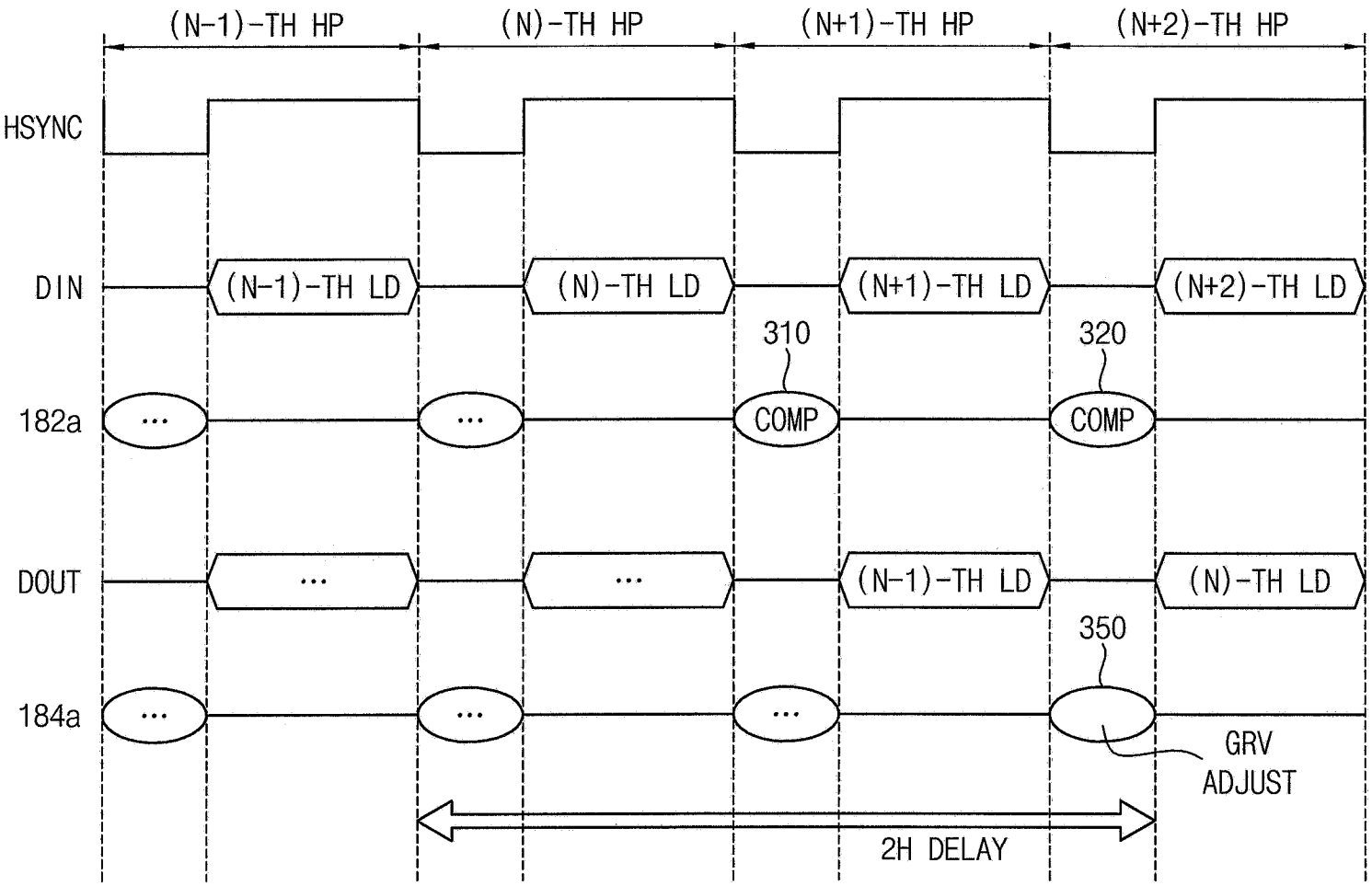
FIG. 11 is a timing diagram for describing an operation of the horizontal crosstalk compensator of FIG. 9 according to example embodiments.
Figure 12:
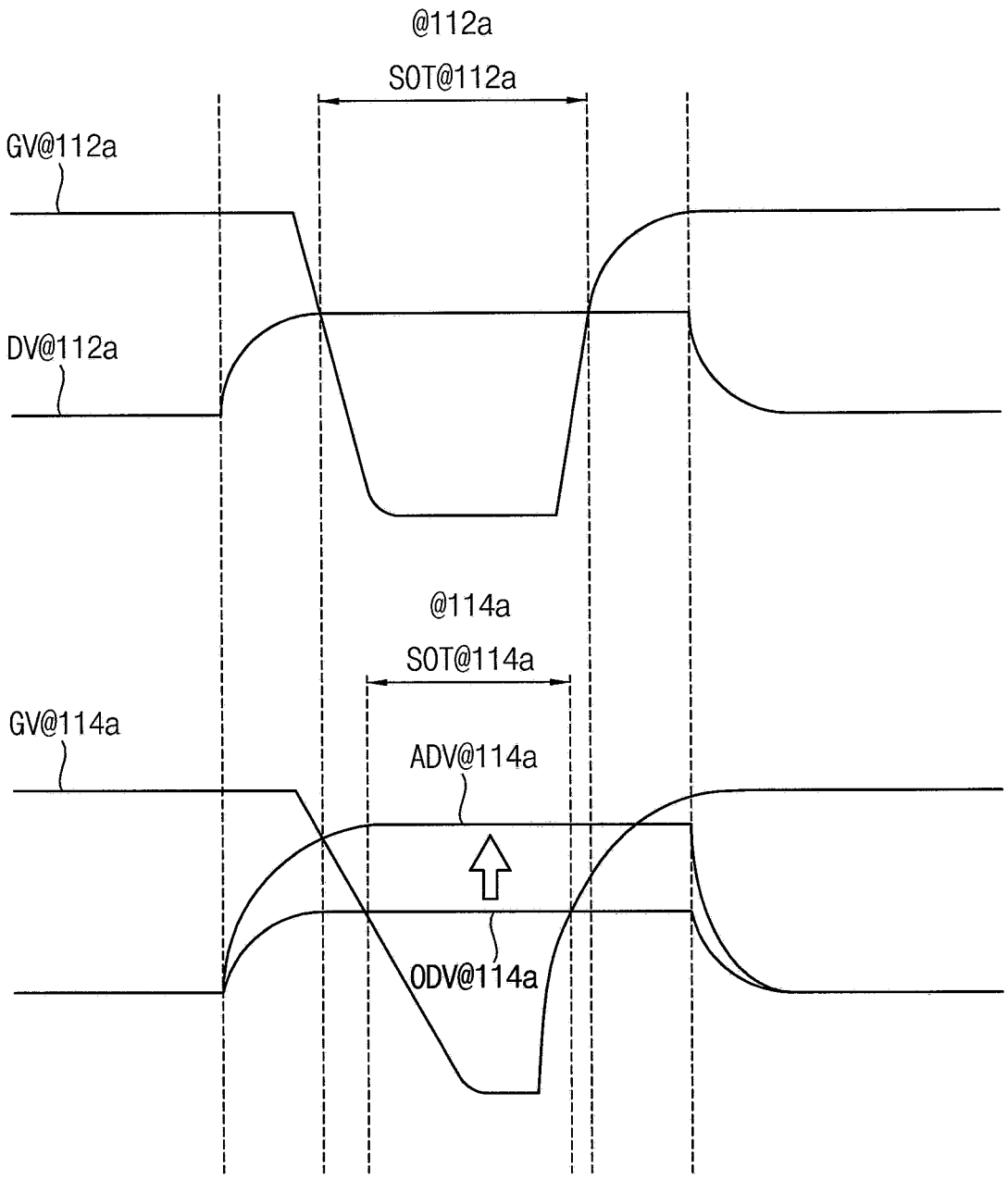
FIG. 12 is a diagram for describing an example where horizontal crosstalk is compensated by adjusting a plurality of gamma reference voltages according to example embodiments.

FIG. 3 is a flowchart illustrating a method of operating a display device according to example embodiments, FIG. 4 is a diagram illustrating an example of a plurality of reference gray groups in a display device according to example embodiments, FIG. 5 is a block diagram illustrating a gray group data generator included in a display device according to example embodiments, FIG. 6 is a timing diagram for describing an operation of the gray group data generator of FIG. 5, FIG. 7 is a block diagram illustrating a horizontal crosstalk determiner included in a display device according to example embodiments, FIG. 8 is a timing diagram for describing an operation of the horizontal crosstalk determiner of FIG. 7, FIG. 9 is a block diagram illustrating a horizontal crosstalk compensator included in a display device according to example embodiments, FIG. 10A is a diagram illustrating an example where a difference between a current row reference gray group distribution and an adjacent row reference gray group distribution is within a reference distribution difference range, FIG. 10B is a diagram illustrating an example where a difference between a current row reference gray group distribution and an adjacent row reference gray group distribution exceeds a reference distribution difference range, FIG. 11 is a timing diagram for describing an operation of the horizontal crosstalk compensator of FIG. 9, and FIG. 12 is a diagram for describing an example where horizontal crosstalk is compensated by adjusting a plurality of gamma reference voltages.

Referring to FIGS. 1 and 3, in a display device 100 according to example embodiments, a gray group data generator 160 may receive current line data for pixels PX located in a current row, and may generate current row gray group data representing a reference gray group distribution of the current row based on the current line data (S210). For example, the reference gray group distribution of each row (i.e., a row of the pixels PX connected to the same gate line) of a display panel 110 may represent numbers of pixel data for the pixels PX located in the each row respectively pertaining to a plurality of reference gray groups corresponding to a plurality of reference gray levels. For example, as illustrated in FIG. 4, the plurality of reference gray levels may include a 0-gray level 0G, a 3-gray level 3G, an 11-gray level 11G, a 23-gray level 23G, a 35-gray level 35G, a 51-gray level 51G, a 87-gray level 87G, a 151-gray level 151G, a 203-gray level 203G and a 255-gray level 255G, and the plurality of reference gray groups may include a first reference gray group RGG1 including the 0-gray level 0G, a second reference gray group RGG2 including a 1-gray level 1G through the 3-gray level 3G, a third reference gray group RGG3 including a 4-gray level 4G through the 11-gray level 11G, a fourth reference gray group RGG4 including a 12-gray level 12G through the 23-gray level 23G, a fifth reference gray group RGG5 including a 24-gray level 24G through the 35-gray level 35G, a sixth reference gray group RGG6 including a 36-gray level 36G through the 51-gray level 51G, a seventh reference gray group RGG7 including a 52-gray level 52G through the 87-gray level 87G, an eighth reference gray group RGG8 including a 88-gray level 88G through the 151-gray level 151G, a ninth reference gray group RGG9 including a 152-gray level 152G through the 203-gray level 203G, and a tenth reference gray group RGG10 including a 204-gray level 204G through the 255-gray level 255G. Although FIG. 4 illustrates an example where a boundary of each reference gray group RGG1 through RGG10 is determined by the reference gray level, each reference gray group RGG1 through RGG10 may not be limited to the example of FIG. 4. For example, a middle value of each reference gray group RGG1 through RGG10 may be determined by the reference gray level.

In some example embodiments, as illustrated in FIG. 5, the gray group data generator 160*a* may include a gray group classifier 162*a*, a current group data accumulator 164*a* and at least one gray group data register 166*a*, 167*a* and 168*a*. The gray group classifier 162*a* may receive (e.g., sequentially receive) a plurality of pixel data included in the current line data, and may classify the plurality of pixel data into the plurality of reference gray groups respectively corresponding to the plurality of reference gray levels. The gray group classifier 162*a* may provide a pixel group value PXGV representing the reference gray group to which each pixel data pertains to the current group data accumulator 164*a*. The current group data accumulator 164*a* may generate the current row gray group data GGD by accumulating numbers of the plurality of pixel data respectively pertaining to the plurality of reference gray groups until receiving the current line data is completed. The at least one gray group data register 166*a*, 167*a* and 168*a* may store the current row gray group data GGD after receiving the current line data (e.g., after receiving the current line data is completed). In some example embodiments, the gray group data generator 160*a* may include (e.g., as the at least one gray group data register 166*a*, 167*a* and 168*a*), first through third gray group data registers 166*a*, 167*a* and 168*a*.

As illustrated in FIGS. 5 and 6, the gray group classifier 162*a* may receive (e.g., sequentially receive) input image data DIN and a plurality of line data in an order from the first row to the last row of the display panel 110 from a host processor. For example, the gray group classifier 162*a* may receive (N−1)-th line data for an (N−1)-th row in an (N−1)-th horizontal period (N−1)-TH HP, may receive N-th line data for an N-th row in an N-th horizontal period (N)-TH HP, and may receive (N+1)-th line data for an (N+1)-th row in an (N+1)-th horizontal period (N+1)-TH HP (where N is an integer greater than 1). In some example embodiments, the gray group classifier 162*a* may receive the input image data DIN in a form of first through fourth RGB data RGB1 through RGB4 received through four data channels. In some example embodiments, each RGB data RGB1 through RGB4 may be 24-bit RGB data RGB1[23:0] through RGB4[23:0] (e.g., where each pixel data is 24-bit data).

For example, at a second clock of a dot clock signal DCLK (or a pixel clock signal) in the (N−1)-th horizontal period (N−1)-TH HP, the gray group classifier 162*a* may receive, as the first through fourth RGB data RGB1 through RGB4, first through fourth pixel data PX1D through PX4D for first through fourth pixels PX located in the (N−1)-th row. At a third clock of the dot clock signal DCLK in the (N−1)-th horizontal period (N−1)-TH HP, the gray group classifier 162*a* may provide the current group data accumulator 164*a* or CGDA with pixel group values PXGV representing the reference gray groups to which the first through fourth pixel data PX1D through PX4D pertain, and may receive, as the first through fourth RGB data RGB1 through RGB4, fifth through eighth pixel data PX5D through PX8D for fifth through eighth pixels PX located in the (N−1)-th row. The current group data accumulator 164*a* or CGDA may store gray group data 1-4GD for the first through fourth pixel data PX1D through PX4D. At a fourth clock of the dot clock signal DCLK in the (N−1)-th horizontal period (N−1)-TH HP, the gray group classifier 162*a* may provide the current group data accumulator 164*a* or CGDA with pixel group values PXGV representing the reference gray groups to which the fifth through eighth pixel data PX5D through PX8D pertain, and the current group data accumulator 164*a* or CGDA may store gray group data 1-8GD for the first through eighth pixel data PX1D through PX8D. Similarly, at the last clock of the dot clock signal DCLK in the (N−1)-th horizontal period (N−1)-TH HP, the gray group classifier 162*a* may receive, as the fourth RGB data RGB4, last pixel data PXMD for a last pixel PX located in the (N−1)-th row. Further, at a first clock of the dot clock signal DCLK in the N-th horizontal period (N)-TH HP, the current group data accumulator 164*a* or CGDA may store gray group data 1-MGD for the first through last pixel data PX1D through PXMD, or (N−1)-th row gray group data (N−1)-TH GGD representing the reference gray group distribution of the (N−1)-th row. As described above, once receiving the (N−1)-th line data for the (N−1)-th row is completed, the (N−1)-th row gray group data (N−1)-TH GGD for the (N−1)-th row may be stored in the current group data accumulator 164*a* or CGDA, and the (N−1)-th row gray group data (N−1)-TH GGD stored in the current group data accumulator 164*a* or CGDA may be transferred or stored to the first gray group data register 166*a* or GGDR1.

In this manner, for example, after receiving the N-th line data for the N-th row is completed, the (N−1)-th row gray group data (N−1)-TH GGD stored in the first gray group data register 166*a* or GGDR1 may be transferred to and/or stored in the second gray group data register 167*a* or GGDR2, and N-th row gray group data (N)-TH GGD stored in the current group data accumulator 164*a* or CGDA may be transferred to and/or stored in the first gray group data register 166*a* or GGDR1. Further, once receiving the N-th line data for the N-th row is completed, the (N−1)-th row gray group data (N−1)-TH GGD stored in the second gray group data register 167*a* or GGDR2 may be transferred to and/or stored in the third gray group data register 168*a* or GGDR3, the N-th row gray group data (N)-TH GGD stored in the first gray group data register 166*a* or GGDR1 may be transferred to and/or stored in the second gray group data register 167*a* or GGDR2, and (N+1)-th row gray group data (N+1)-TH GGD stored in the current group data accumulator 164*a* or CGDA may be transferred to and/or stored in the first gray group data register 166*a* or GGDR1. In some example embodiments, each pixel PX may include a red sub-pixel, a green sub-pixel and a blue sub-pixel, and the gray group data for each row may be generated per color. For example, the gray group data for each row may include red gray group data, green gray group data and blue gray group data respectively for red sub-pixels, green sub-pixels and blue sub-pixels in the each row.

Referring again to FIGS. 1 and 3, a horizontal crosstalk determiner 170 may determine, based on a difference between the plurality of pixel data included in the current line data, whether horizontal crosstalk occurs in the current row (S220). In some example embodiments, as illustrated in FIG. 7, the horizontal crosstalk determiner 170*a* may include a pixel data difference calculator 172*a*, a threshold difference comparator 174*a* and an excess count accumulator 176*a*. The pixel data difference calculator 172*a* may receive (e.g., sequentially receive) the plurality of pixel data included in the current line data, and may calculate a pixel data difference PXDIF between two adjacent pixel data of the plurality of pixel data. The threshold difference comparator 174*a* may compare the pixel data difference PXDIF with a threshold difference value, and may count the number ECNT of the pixel data difference PXDIF exceeding the threshold difference value. The excess count accumulator 176*a* may store the counted number ECNT of the pixel data difference PXDIF exceeding the threshold difference value. The horizontal crosstalk determiner 170*a* may determine that the horizontal crosstalk occurs when the counted number ECNT stored in the excess count accumulator 176*a* is greater than or equal to a reference count value.

As illustrated in FIGS. 7 and 8, the input image data DIN may be provided from the host processor in the form of the first through fourth RGB data RGB1 through RGB4 through the four data channels, and the first through fourth RGB data RGB1 through RGB4 may include first through fourth R data R1 through R4, first through fourth G data G1 through G4 and first through fourth B data B1 through B4. Further, in some example embodiments, the horizontal crosstalk determiner 170*a* may determine, for each color, whether the horizontal crosstalk occurs.

For example, at a second clock of the dot clock signal DCLK, in a case where the first through fourth R data R1 through R4 represent values of 0, 1, 11 and 12, the pixel data difference calculator 172*a* may calculate a pixel data difference R_PXDIF2 representing a value of 1 corresponding to a difference between a first red sub-pixel and a second red sub-pixel located in the same row, may calculate a pixel data difference R_PXDIF3 representing a value of 10 corresponding to a difference between the second red sub-pixel and a third red sub-pixel located in the same row, and may calculate a pixel data difference R_PXDIF4 representing a value of 1 corresponding to a difference between the third red sub-pixel and a fourth red sub-pixel located in the same row. The threshold difference comparator 174*a* may compare the pixel data difference R_PXDIF1 through R_PXDIF4 with the threshold difference value including, for example, a positive threshold difference value of +100 and a negative threshold difference value of −100. When the pixel data difference R_PXDIF1 through R_PXDIF4 is less than the positive threshold difference value and greater than the negative threshold difference value, the threshold difference comparator 174*a* may provide, as the counted number ECNT, a positive excess number PECNT of 0 and a negative excess number NECNT of 0 to the excess count accumulator 176*a*. The excess count accumulator 176*a* may store the positive excess number PECNT of 0 and the negative excess number NECNT of 0.

At a third clock of the dot clock signal DCLK, in a case where the first through fourth R data R1 through R4 represent values of 128, 124, 12 and 15, the pixel data difference calculator 172*a* may calculate a pixel data difference R_PXDIF1 representing a value of 116 corresponding to a difference between the fourth red sub-pixel and a fifth red sub-pixel located in the same row, a pixel data difference R_PXDIF2 representing a value of −4 corresponding to a difference between the fifth red sub-pixel and a sixth red sub-pixel located in the same row, may calculate a pixel data difference R_PXDIF3 representing a value of −112 corresponding to a difference between the sixth red sub-pixel and a seventh red sub-pixel located in the same row, and may calculate a pixel data difference R_PXDIF4 representing a value of 3 corresponding to a difference between the seventh red sub-pixel and an eighth red sub-pixel located in the same row. The threshold difference comparator 174*a* may compare the pixel data difference R_PXDIF1 through R_PXDIF4 with the positive threshold difference value of +100 and the negative threshold difference value of −100, and may provide the excess count accumulator 176*a* with the positive excess number PECNT of 1 representing there is one pixel data difference R_PXDIF1 greater than or equal to the positive threshold difference value and the negative excess number NECNT of 1 representing there is one pixel data difference R_PXDIF3 less than or equal to the negative threshold difference value. The excess count accumulator 176*a* may store or accumulate the positive excess number PECNT of 1 and the negative excess number NECNT of 1. In this manner, once receiving line data for one row is completed, the positive excess number PECNT and the negative excess number NECNT for the one row may be stored in the excess count accumulator 176*a*. When at least one of the positive excess number PECNT and the negative excess number NECNT is greater than or equal to the reference count value, the horizontal crosstalk determiner 170*a* may determine that the horizontal crosstalk occurs. In some example embodiments, whether the horizontal crosstalk occurs in each row may be determined for each color.

Referring again to FIGS. 1 and 3, in a case where the horizontal crosstalk is determined to not occur in the current row (S220: NO), a horizontal crosstalk compensator 180 may not adjust a plurality of gamma gray voltages GRV, and a gamma voltage generator 130 may generate original gamma gray voltages GRV (S260). The display device 100 may display an image based on the original gamma gray voltages GRV.

In a case where the horizontal crosstalk is determined to occur in the current row (S220: YES), the horizontal crosstalk compensator 180 may compare the current row gray group data with adjacent row gray group data representing the reference gray group distribution of an adjacent row (e.g., a previous row and/or a next row) (S230 and S240), and may selectively adjust the plurality of gamma reference voltages GRV according to a result of the comparison between the current row gray group data and the adjacent row gray group data (S250). For example, in a case where the reference gray group distribution of the current row is different by more than a reference distribution difference range from the reference gray group distributions of the previous row and the next row (S230: NO and S240: NO), the gamma voltage generator 130 may generate the original gamma gray voltages GRV (S260), and the display device 100 may display an image based on the original gamma gray voltages GRV. In a case where the reference gray group distributions of consecutive two rows are different from each other, even if the horizontal crosstalk occurs in each row, the horizontal crosstalk may not be perceived. Thus, if the consecutive two rows have different reference gray group distributions, a compensation operation for the horizontal crosstalk, or an operation that adjusts the plurality of gamma reference voltages GRV may not be performed. Alternatively, in a case where a difference between the reference gray group distribution of the current row and the reference gray group distribution of the previous row is within the reference distribution difference range (S230: YES) or in a case where a difference between the reference gray group distribution of the current row and the reference gray group distribution of the next row is within the reference distribution difference range (S240: YES), the horizontal crosstalk compensator 180 may adjust the plurality of gamma gray voltages GRV (S250).

In some example embodiments, as illustrated in FIGS. 9-11, the horizontal crosstalk compensator 180*a* may include a gray group data comparator 182*a* and a gamma reference voltage controller 184*a*. The gray group data comparator 182*a* may compare the current row gray group data CRGGD with the adjacent row gray group data PRGGD, and may determine whether the difference between the reference gray group distribution of the current row and the reference gray group distribution of the adjacent row is within the reference distribution difference range. In some example embodiments, the gray group data comparator 182*a* may determine that the difference between the reference gray group distribution of the current row and the reference gray group distribution of the adjacent row is within the reference distribution difference range when, with respect to each reference gray group, a difference between the number of pixel data (or the number of pixels PX) pertaining to the each reference gray group represented by the current row gray group data CRGGD and the number of pixel data (or the number of pixels PX) pertaining to the each reference gray group represented by the adjacent row gray group data PRGGD is less than or equal to a reference number difference. For example, as illustrated in FIG. 10A, when, with respect to each of respective reference gray groups RRG1 through RRG10, a difference PXCD between the number of pixel data represented by the current row gray group data CRGGD and the number of pixel data represented by the adjacent row gray group data PRGGD is less than a predetermined reference number difference, the gray group data comparator 182*a* may determine that the current row gray group data CRGGD and the adjacent row gray group data PRGGD are similar. In another example, as illustrated in FIG. 10B, when, with respect to at least one reference gray group (e.g., RGG2), a difference PXCD between the number of pixel data represented by the current row gray group data CRGGD and the number of pixel data represented by the adjacent row gray group data PRGGD is greater than the predetermined reference number difference, the gray group data comparator 182*a* may determine that the current row gray group data CRGGD and the adjacent row gray group data PRGGD are dissimilar, or that the difference between the reference gray group distribution of the current row and the reference gray group distribution of the adjacent row exceeds the reference distribution difference range.

The gamma reference voltage controller 184*a* may adjust the plurality of gamma reference voltages GRV when the horizontal crosstalk is determined to occur in the current row and the difference between the reference gray group distribution of the current row and the reference gray group distribution of the adjacent row is within the reference distribution difference range.

For example, as illustrated in FIGS. 9 and 11, in the (N−1)-th horizontal period (N−1)-TH HP, the display device 100 may receive the (N−1)-th line data (N−1)-TH LD, and a line data memory 190 may store the (N−1)-th line data (N−1)-TH LD. Once receiving the (N−1)-th line data (N−1)-TH LD is completed, the (N−1)-th row gray group data (N−1)-TH GGD may be stored in the first gray group data register 166*a*.

In the N-th horizontal period (N)-TH HP, the display device 100 may receive the N-th line data (N)-TH LD, and the line data memory 190 may store the (N−1)-th line data (N−1)-TH LD as previous line data, and may further store the N-th line data (N)-TH LD as current line data. Once receiving the N-th line data (N)-TH LD is completed, the (N−1)-th row gray group data (N−1)-TH GGD may be stored in the second gray group data register 167*a*, and the N-th row gray group data (N)-TH GGD may be stored in the first gray group data register 166*a*. The gray group data comparator 182*a* may receive, as the current and adjacent row gray group data CRGGD and PRGGD, the N-th and (N−1)-th gray group data (N)-TH GGD and (N−1)-TH GGD from the first and second gray group data registers 166*a* and 167*a*, and may perform a comparison operation (COMP) 310 on the N-th and (N−1)-th gray group data (N)-TH GGD and (N−1)-TH GGD.

In the (N+1)-th horizontal period (N+1)-TH HP, the (N−1)-th line data (N−1)-TH LD stored in the line data memory 190 may be provided to a data driver 140, and the pixels PX in the (N−1)-th row may emit light based on data voltages DV corresponding to the (N−1)-th line data (N−1)-TH LD. Further, the display device 100 may receive the (N+1)-th line data (N+1)-TH LD, and the line data memory 190 may store the (N+1)-th line data (N+1)-TH LD as next line data. In some example embodiments, the line data memory 190 may store two line data at any time point, and thus the line data memory 190 may have a memory size corresponding to the two line data. For example, when receiving the next line data (e.g., the (N+1)-th line data (N+1)-TH LD) is completed, the line data memory 190 may output the previous line data (e.g., the (N−1)-th line data (N−1)-TH LD) to the data driver 140, may store the current line data as the previous line data, and may store the next line data as the current line data.

Once receiving the (N+1)-th line data (N+1)-TH LD is completed, the gray group data comparator 182*a* may receive, as the current and adjacent row gray group data CRGGD and PRGGD, the (N+1)-th and N-th gray group data (N+1)-TH GGD and (N)-TH GGD from the first and second gray group data registers 166*a* and 167*a*, and may perform a comparison operation 320 on the (N+1)-th and N-th gray group data (N+1)-TH GGD and (N)-TH GGD.

As described above, if the horizontal crosstalk is determined to occur in the current row, or the N-th row, the comparison operation 310 on the N-th and (N−1)-th gray group data (N)-TH GGD and (N−1)-TH GGD and/or the comparison operation 320 on the (N+1)-th and N-th gray group data (N+1)-TH GGD and (N)-TH GGD may be performed.

In a case where, by the comparison operations 310 and/or 320, the reference gray group distribution of the N-th row and the reference gray group distribution of the (N−1)-th row or the (N+1)-th row are determined to be similar (or to have a difference within the reference distribution difference range), the gamma reference voltage controller 184*a* may perform an adjusting operation (GRV ADJUST) 350 that adjusts the plurality of gamma reference voltages GRV.

In some example embodiments, the gamma reference voltage controller 184*a* may calculate a sum (or a total sum) of the plurality of pixel data included in the current line data, or the N-th line data (N)-TH LD, may compare the sum of the plurality of pixel data with a line data reference value, and may adjust (e.g., increase or decrease) the plurality of gamma reference voltages GRV according to a result of the comparison between the sum of the plurality of pixel data and the line data reference value. For example, the gamma reference voltage controller 184*a* may decrease the plurality of gamma reference voltages GRV when the sum of the plurality of pixel data is greater than the line data reference value, and may increase the plurality of gamma reference voltages GRV when the sum of the plurality of pixel data is less than the line data reference value.

FIG. 12 illustrates an example where the gamma reference voltages GRV are increased and the data voltages DV are increased by the increased gamma reference voltages GRV. In FIG. 12, a gate voltage GV@112*a* and a data voltage DV@112*a* for a pixel PX in a first portion 112*a* of a display panel 110*a* illustrated in FIG. 2A are illustrated, and a gate voltage GV@114*a*, an original data voltage ODV@114*a* and an adjusted data voltage ADV@114*a* for a pixel PX in a second portion 114*a* of the display panel 110*a* are also illustrated. Because low gray data (e.g., 0-gray data) are provided to some pixels PX in the second portion 114*a* of the display panel 110*a*, gate loads of gate lines in the second portion 114*a* of the display panel 110*a* may be increased. Thus, a scan on time SOT@114*a* for the pixels PX in the second portion 114*a* may be decreased compared with a scan on time SOT@112*a* for the pixels PX in the first portion 112*a*. Accordingly, in a case where the original data voltage ODV@114*a* is substantially the same as the data voltage DV@112*a* for the pixel PX in the first portion 112*a* is applied to the pixel PX in the second portion 114*a*, the pixel PX in the second portion 114*a* may emit light with luminance higher than desired luminance. However, if the low gray data (e.g., the 0-gray data) are provided to some pixels PX in the second portion 114*a*, the sum of the plurality of pixel data included in each line data for the second portion 114*a* may be less than the line data reference value, and the gamma reference voltage controller 184*a* may increase the plurality of gamma reference voltages GRV. Accordingly, the adjusted data voltage ADV@114*a* generated based on the increased gamma reference voltages GRV may be increased compared with the original data voltage ODV@114*a*, and thus the pixel PX in the second portion 114*a* may emit light with the desired luminance. In some example embodiments, a decrement or an increment of the plurality of gamma reference voltages GRB may be determined in proportion to a difference between the sum of the plurality of pixel data and the line data reference value.

If the adjusting operation 350 is performed, the data driver 140 generate the data voltages DV corresponding to the current line data, or the N-th line data (N)-TH LD based on the adjusted gamma reference voltages GRV, and the pixels PX located in the current row may display an image in response to the data voltages DV generated based on the adjusted gamma reference voltages GRV (S270). Accordingly, the horizontal crosstalk in the current row may be compensated. In a conventional display device, the gamma reference voltages GRV may be adjusted after receiving one frame data is completed, and thus there is at least one frame delay between receiving image data and displaying an image. However, in the display device 100 according to example embodiments, the N-th line data (N)-TH LD may be received from a host processor in the N-th horizontal period (N)-TH HP, the image based on the N-th line data (N)-TH LD may be displayed in an (N+2)-th horizontal period (N+2)-TH HP, and thus there is a delay corresponding to only two horizontal times (2H) between receiving each line data and displaying the image. Thus, in the display device 100 according to example embodiments, the horizontal crosstalk may be compensated in substantially real time.

Figure 13:
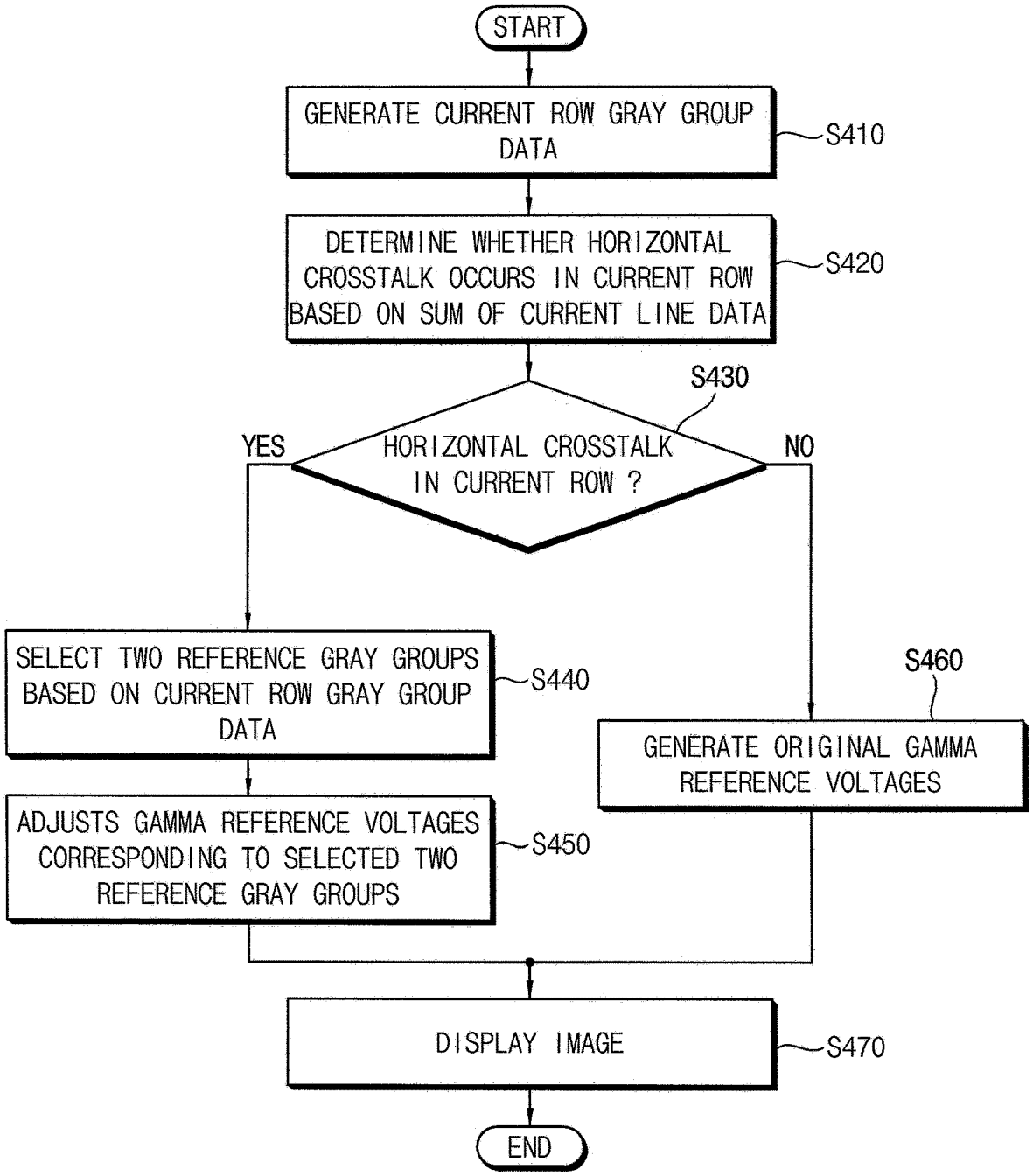
FIG. 13 is a flowchart illustrating a method of operating a display device according to example embodiments.
Figure 14:
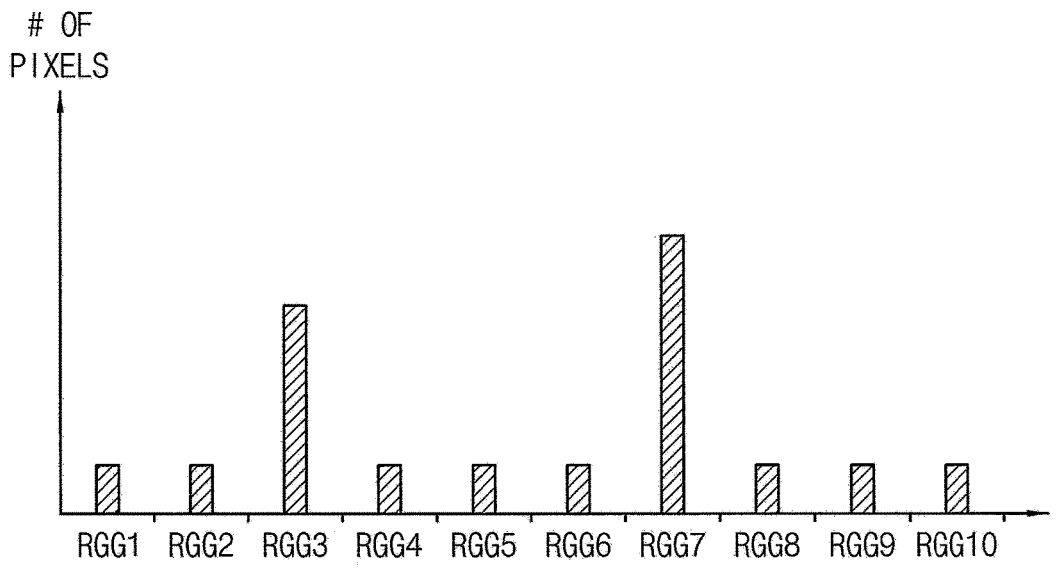
FIG. 14 is a diagram for describing an example where reference gray groups are selected in a display device according to example embodiments.
Figure 15:
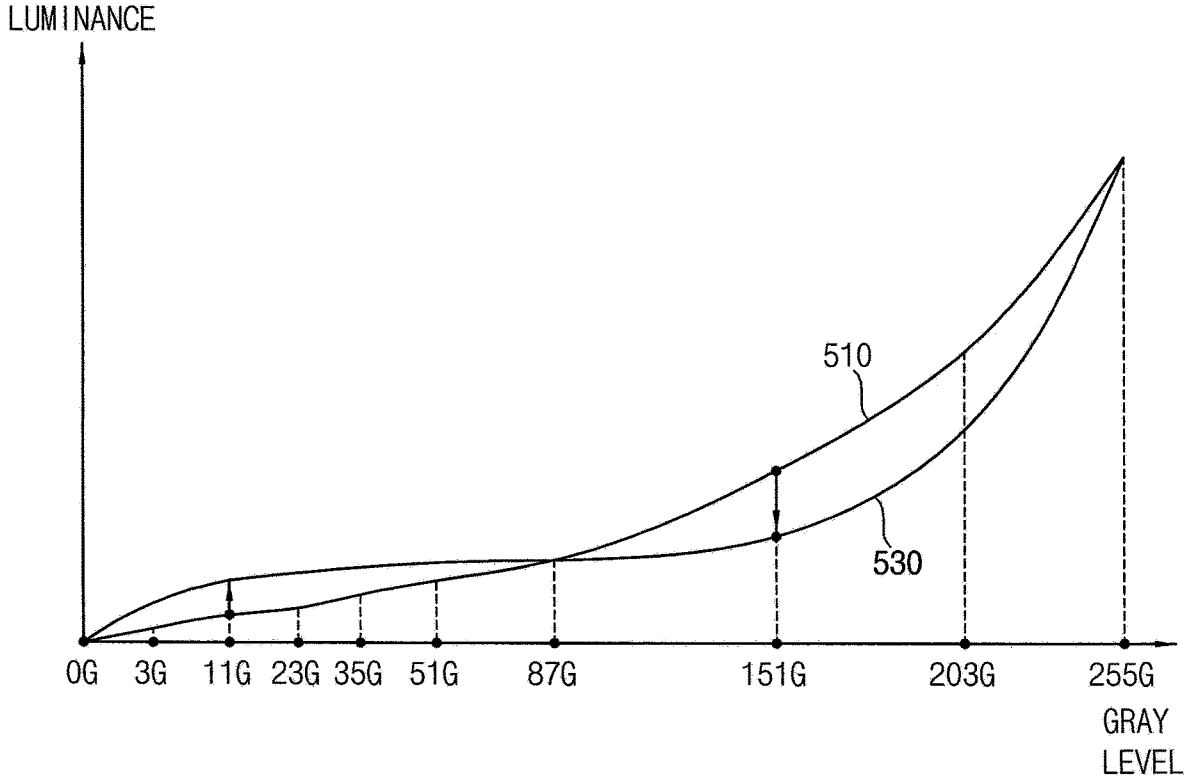
FIG. 15 is a diagram for describing an example where gamma reference voltages corresponding to selected reference gray groups are adjusted in a display device according to example embodiments.

FIG. 13 is a flowchart illustrating a method of operating a display device according to example embodiments, FIG. 14 is a diagram for describing an example where reference gray groups are selected in a display device according to example embodiments, and FIG. 15 is a diagram for describing an example where gamma reference voltages corresponding to selected reference gray groups are adjusted in a display device according to example embodiments.

Referring to FIGS. 1 and 13, in a display device 100 according to example embodiments, a gray group data generator 160 may receive current line data for pixels PX located in a current row, and may generate current row gray group data representing a reference gray group distribution of the current row based on the current line data (S410).

A horizontal crosstalk determiner 170 may determine, based on a sum (or a total sum) of a plurality of pixel data included in the current line data, whether horizontal crosstalk occurs in the current row (S420). In some example embodiments, the horizontal crosstalk determiner 170 may calculate the sum of the plurality of pixel data included in the current line data, and may compare the sum of the plurality of pixel data with a line data reference value. The horizontal crosstalk determiner 170 may determine that the horizontal crosstalk does not occur in the current row when the sum of the plurality of pixel data is greater than the line data reference value, and may determine that the horizontal crosstalk occurs in the current row when the sum of the plurality of pixel data is less than or equal to the line data reference value. For example, in a case where the sum of the plurality of pixel data is less than or equal to the line data reference value, a gate load of a corresponding gate line may be increased, a scan on time may be decreased, and thus the horizontal crosstalk may be determined to occur.

In a case where the horizontal crosstalk is determined not to occur in the current row (S430: NO), a horizontal crosstalk compensator 180 may not adjust a plurality of gamma gray voltages GRV, and a gamma voltage generator 130 may generate original gamma gray voltages GRV (S460). The display device 100 may display an image based on the original gamma gray voltages GRV.

In a case where the horizontal crosstalk is determined to occur in the current row (S220: YES), the horizontal crosstalk compensator 180 may select two reference gray groups from among a plurality of reference gray groups (S440), and may adjust two gamma reference voltages corresponding to the selected two reference gray groups from among the plurality of gamma reference voltages GRV (S450). In some example embodiments, the horizontal crosstalk compensator 180 may select the two reference gray groups to which the most number of pixel data and the second most number of pixel data pertain among the plurality of reference gray groups. For example, as illustrated in FIG. 14, in a case where third and seventh reference gray groups RGG3 and RGG7 include the most number of pixel data (or pixels) and the second most number of pixel data (or pixels), the horizontal crosstalk compensator 180 may select the third and seventh reference gray groups RGG3 and RGG7. Further, if the third and seventh reference gray groups RGG3 and RGG7 are selected, as illustrated in FIG. 15, the horizontal crosstalk compensator 180 may adjust two gamma reference voltages, for example a 11-gray voltage and a 151-gray voltage corresponding to the selected third and seventh reference gray groups RGG3 and RGG7. In some example embodiments, the horizontal crosstalk compensator 180 may increase a gamma reference voltage corresponding to a relatively high reference gray level from among the two gamma reference voltages corresponding to the selected two reference gray groups, and may decrease a gamma reference voltage corresponding to a relatively low reference gray level from among the two gamma reference voltages corresponding to the selected two reference gray groups. For example, as illustrated in FIG. 15, the horizontal crosstalk compensator 180 may increase the 151-gray voltage corresponding to a relatively high 151-gray level from among the 11-gray voltage and the 151-gray voltage corresponding to the selected third and seventh reference gray groups RGG3 and RGG7, thereby decreasing luminance corresponding to the 151-gray level. Further, the horizontal crosstalk compensator 180 may decrease the 11-gray voltage corresponding to a relatively low 11-gray level from among the 11-gray voltage and the 151-gray voltage corresponding to the selected third and seventh reference gray groups RGG3 and RGG7, thereby increasing luminance corresponding to the 11-gray level.

If the two gamma reference voltages corresponding to the selected two reference gray groups are adjusted (S450), the pixels PX in the current row may display an image in response to the data voltages DV generated based on the plurality of gamma reference voltages GRV including the adjusted two gamma reference voltages (S470). Accordingly, in the display device 100 according to example embodiments, the horizontal crosstalk may be compensated in substantially real time.

Figure 16:
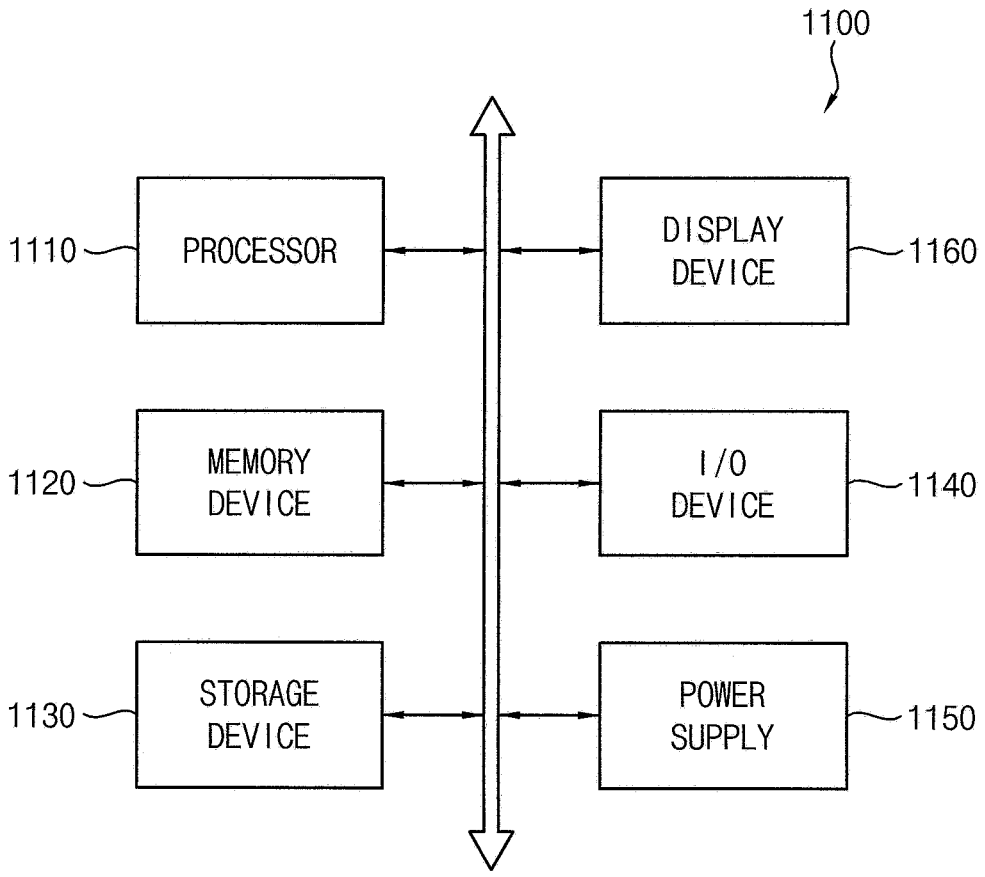
FIG. 16 is a block diagram illustrating an electronic device including a display device according to example embodiments.

FIG. 16 is a block diagram illustrating an electronic device including a display device according to example embodiments.

Referring to FIG. 16, an electronic device 1100 may include a processor 1110, a memory device 1120, a storage device 1130, an input/output (I/O) device 1140, a power supply 1150, and a display device 1160. The electronic device 1100 may further include a plurality of ports for communicating a video card, a sound card, a memory card, a universal serial bus (USB) device, other electric devices, etc.

The processor 1110 may perform various computing functions or tasks. The processor 1110 may be an application processor (AP), a microprocessor, a central processing unit (CPU), etc. The processor 1110 may be coupled to other components via an address bus, a control bus, a data bus, etc. Further, in some example embodiments, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc., and an output device such as a printer, a speaker, etc. The power supply 1150 may supply power for operations of the electronic device 1100. The display device 1160 may be coupled to other components through the buses or other communication links.

The display device 1160 may determine whether horizontal crosstalk occurs in a current row based on a difference between a plurality of pixel data included in current line data, and may compare current row gray group data and adjacent row gray group data. When it is determined that the horizontal crosstalk occurs and a difference between a current row reference gray group distribution and an adjacent row reference gray group distribution is within a reference distribution difference range, the display device 1160 may adjust a plurality of gamma reference voltages. Accordingly, the horizontal crosstalk may be compensated in substantially real time.

The inventive concepts may be applied to any suitable display device 1160, and any electronic device 1100 including the display device 1160. For example, the inventive concepts may be applied to a mobile phone, a smart phone, a tablet computer, a wearable electronic device, a virtual reality (VR) device, a television (TV), a digital TV, a 3D TV, a personal computer (PC), a home appliance, a laptop computer, a personal digital assistant (PDA), a portable multimedia player (PMP), a digital camera, a music player, a portable game console, a navigation device, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims and their equivalents. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims and their equivalents.

What is claimed is:

1. A display device comprising: a display panel comprising a plurality of pixels; a gray group data generator configured to receive current line data for pixels located in a current row from among the plurality of pixels, and to generate current row gray group data representing a reference gray group distribution of the current row based on the current line data; a horizontal crosstalk determiner configured to determine whether horizontal crosstalk occurs in the current row based on a difference between a plurality of pixel data included in the current line data; a horizontal crosstalk compensator configured to compare the current row gray group data with adjacent row gray group data representing the reference gray group distribution of an adjacent row when the horizontal crosstalk is determined to occur in the current row, and to selectively adjust a plurality of gamma reference voltages according to a result of the comparison between the current row gray group data and the adjacent row gray group data; and a data driver configured to generate data voltages corresponding to the current line data based on the selectively adjusted plurality of gamma reference voltages, and to provide the data voltages to the pixels located in the current row, wherein the gray group data generator comprises: a gray group classifier configured to sequentially receive the plurality of pixel data included in the current line data, and to classify the plurality of pixel data into a plurality of reference gray groups respectively corresponding to a plurality of reference gray levels; a current group data accumulator configured to generate the current row gray group data by accumulating numbers of the plurality of pixel data respectively pertaining to the plurality of reference gray groups until receiving the current line data is completed; and at least one gray group data register configured to store the current row gray group data after receiving the current line data is completed.

2. The display device of claim 1, wherein the at least one gray group data register comprises a first gray group data register, a second gray group data register, and a third gray group data register, wherein, after receiving (N−1)-th line data for an (N−1)-th row as the current line data is completed, (N−1)-th row gray group data is stored in the first gray group data register, where N is an integer greater than 1, wherein, after receiving N-th line data for an N-th row as the current line data is completed, N-th row gray group data is stored in the first gray group data register, and the (N−1)-th row gray group data is stored in the second gray group data register, and wherein, after receiving (N+1)-th line data for an (N+1)-th row as the current line data is completed, (N+1)-th row gray group data is stored in the first gray group data register, the N-th row gray group data is stored in the second gray group data register, and the (N−1)-th row gray group data is stored in the third gray group data register.

3. The display device of claim 1, wherein the horizontal crosstalk determiner comprises:

a pixel data difference calculator configured to sequentially receive the plurality of pixel data included in the current line data, and to calculate a pixel data difference between two adjacent pixel data from among the plurality of pixel data;

a threshold difference comparator configured to compare the pixel data difference with a threshold difference value, and to count a number of the pixel data difference exceeding the threshold difference value; and an excess count accumulator configured to store the counted number of the pixel data difference exceeding the threshold difference value.

4. The display device of claim 3, wherein the horizontal crosstalk determiner is further configured to determine that the horizontal crosstalk occurs when the counted number stored in the excess count accumulator is greater than or equal to a reference count value.

5. The display device of claim 1, wherein the horizontal crosstalk compensator comprises:

a gray group data comparator configured to compare the current row gray group data with the adjacent row gray group data, and to determine whether a difference between the reference gray group distribution of the current row and the reference gray group distribution of the adjacent row is within a reference distribution difference range; and a gamma reference voltage controller configured to adjust the plurality of gamma reference voltages when the horizontal crosstalk is determined to occur in the current row and the difference between the reference gray group distribution of the current row and the reference gray group distribution of the adjacent row is within the reference distribution difference range.

6. The display device of claim 5, wherein the gray group data comparator is further configured to determine that the difference between the reference gray group distribution of the current row and the reference gray group distribution of the adjacent row is within the reference distribution difference range when, with respect to each reference gray group, a difference between a number of the plurality of pixel data pertaining to the each reference gray group represented by the current row gray group data and a number of the plurality of pixel data pertaining to the each reference gray group represented by the adjacent row gray group data is less than or equal to a reference number difference.

7. The display device of claim 5, wherein the gamma reference voltage controller is further configured to calculate a sum of the plurality of pixel data included in the current line data, to compare the sum of the plurality of pixel data with a line data reference value, and to adjust the plurality of gamma reference voltages according to a result of the comparison between the sum of the plurality of pixel data and the line data reference value.

8. The display device of claim 7, wherein the gamma reference voltage controller is further configured to decrease the plurality of gamma reference voltages when the sum of the plurality of pixel data is greater than the line data reference value, and to increase the plurality of gamma reference voltages when the sum of the plurality of pixel data is less than the line data reference value.

9. The display device of claim 8, wherein a decrement or an increment of the plurality of gamma reference voltages is proportional to a difference between the sum of the plurality of pixel data and the line data reference value.

10. The display device of claim 1, further comprising:

a line data memory configured to store previous line data for a previous row and the current line data for the current row, wherein, when receiving next line data for a next row is completed, the line data memory is further configured to output the previous line data to the data driver, to store the current line data as the previous line data, and to store the next line data as the current line data.

11. A display device comprising: a display panel comprising a plurality of pixels; a gray group data generator configured to receive current line data for pixels located in a current row from among the plurality of pixels, and to generate current row gray group data representing a reference gray group distribution of the current row based on the current line data; a horizontal crosstalk determiner configured to determine whether horizontal crosstalk occurs in the current row based on a sum of a plurality of pixel data included in the current line data; a horizontal crosstalk compensator configured to select reference gray groups among a plurality of reference gray groups based on the current row gray group data when the horizontal crosstalk is determined to occur in the current row, and to adjust gamma reference voltages corresponding to the selected reference gray groups among a plurality of gamma reference voltages;

and a data driver configured to generate data voltages corresponding to the current line data based on the plurality of gamma reference voltages including the adjusted gamma reference voltages, and to provide the data voltages to the pixels located in the current row, wherein the horizontal crosstalk compensator is further configured to increase a gamma reference voltage corresponding to a relatively high reference gray level among the selected reference gray groups, and to decrease a gamma reference voltage corresponding to a relatively low reference gray level among the selected reference gray groups.

12. The display device of claim 11, wherein the horizontal crosstalk determiner is further configured to calculate the sum of the plurality of pixel data included in the current line data, and to compare the sum of the plurality of pixel data with a line data reference value.

13. The display device of claim 12, wherein the horizontal crosstalk determiner is further configured to determine that the horizontal crosstalk occurs in the current row when the sum of the plurality of pixel data is less than or equal to the line data reference value.

14. The display device of claim 11, wherein the horizontal crosstalk compensator is further configured to select two reference gray groups among the plurality of reference gray groups, and to adjust two gamma reference voltages corresponding to the selected two reference gray groups among the plurality of gamma reference voltages.

15. The display device of claim 14, wherein the horizontal crosstalk compensator is further configured to select the two reference gray groups to which a most number of the plurality of pixel data and a second most number of the plurality of pixel data pertain among the plurality of reference gray groups.

* * * * *